US010545428B2

(12) United States Patent
Tsurusaki et al.

(10) Patent No.: US 10,545,428 B2
(45) Date of Patent: Jan. 28, 2020

(54) METHOD OF FIXING REGULATING BLADE AND DEVELOPMENT DEVICE

(71) Applicant: CANON KABUSHIKI KAISHA, Tokyo (JP)

(72) Inventors: Teruaki Tsurusaki, Moriya (JP); Masafumi Takahashi, Tsukubamirai (JP); Shunichi Koga, Abiko (JP); Tomohiro Shiomi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/986,263

(22) Filed: May 22, 2018

(65) Prior Publication Data

US 2018/0341193 A1 Nov. 29, 2018

(30) Foreign Application Priority Data

May 29, 2017 (JP) ..... 2017-105987
Apr. 13, 2018 (JP) ..... 2018-077955

(51) Int. Cl.
*G03G 15/08* (2006.01)
*G03G 21/16* (2006.01)
*G03G 15/095* (2006.01)

(52) U.S. Cl.
CPC ..... *G03G 15/0812* (2013.01); *G03G 21/1647* (2013.01); *G03G 15/095* (2013.01); *G03G 2221/163* (2013.01)

(58) Field of Classification Search
CPC ..... G03G 15/0812; G03G 15/095; G03G 21/1647; G03G 2221/163
See application file for complete search history.

(56) References Cited

U.S. PATENT DOCUMENTS 4,373,798 A * 2/1983 Tsukada ..... G03G 15/09 399/267
4,624,545 A * 11/1986 Yasuda ..... G03G 15/0914 399/274
5,234,786 A * 8/1993 Ueda ..... G03G 13/09 430/101
5,978,636 A * 11/1999 Yamamoto ..... G03G 15/0812 399/274
6,223,014 B1 * 4/2001 Niwano ..... G03G 15/0812 399/284
7,953,352 B2 * 5/2011 Dobbertin ..... G03G 15/0812 399/274

(Continued)

FOREIGN PATENT DOCUMENTS

JP 2014-197175 A 10/2014

*Primary Examiner* — Ryan D Walsh
(74) *Attorney, Agent, or Firm* — Canon U.S.A., Inc. I.P. Division

(57) ABSTRACT

A force for warping a regulating blade is imparted to the regulating blade in such a manner that a gap between a developer bearing member supported by a development frame member and the regulating blade attached to an attaching portion of the development frame member falls within a predetermined range over a longitudinal direction of the developer bearing member. The regulating blade is fixed to the attaching portion in a state in which the regulating blade is warped by the force imparted to the regulating blade and the gap is within the predetermined range over the longitudinal direction of the developer bearing member.

25 Claims, 18 Drawing Sheets

(56) References Cited

U.S. PATENT DOCUMENTS

| | | | | |
|---|---|---|---|---|
| 2007/0177906 | A1* | 8/2007 | Yamanaka | G03G 15/0812 399/279 |
| 2008/0063437 | A1* | 3/2008 | Sheen | G03G 15/0812 399/284 |
| 2008/0131173 | A1* | 6/2008 | Lee | G03G 15/0812 399/284 |
| 2013/0251415 | A1* | 9/2013 | Ishii | G03G 15/0173 399/274 |
| 2013/0287458 | A1* | 10/2013 | Nagata | G03G 21/1695 399/323 |
| 2014/0321887 | A1 | 10/2014 | Matsumoto et al. | |
| 2015/0043950 | A1 | 2/2015 | Yasumoto et al. | |

* cited by examiner

METHOD OF FIXING REGULATING BLADE AND DEVELOPMENT DEVICE

BACKGROUND OF THE INVENTION

Field of the Invention

The present invention generally relates to a method of fixing a regulating blade made of, for example, resin. It also related to a development device equipped with the regulating blade made of resin, for example.

Description of the Related Art

A development device is equipped with a regulating blade (a developer regulating member) which has a coated amount regulating surface (a regulating portion) used to regulate the amount (a developer coated amount) of a developer borne (e.g. carried) on the surface of a developer bearing member, which bears (e.g. carries) a developer used to develop an electrostatic latent image formed on an image bearing member. The regulating blade is arranged to face the developer bearing member over the longitudinal direction of the developer bearing member via a predetermined gap between the regulating blade and the surface of the developer bearing member (the gap being hereinafter referred to as an "SB gap G"). The SB gap G is the shortest distance between the surface of the developer bearing member, which is supported by a frame member of a developer container (a development frame member), and the coated amount regulating surface of the regulating blade, which is attached to the frame member of the developer container. Adjusting the size of the SB gap G enables adjusting the amount of a developer to be conveyed to a development region at which the developer bearing member faces the image bearing member.

A development device discussed in Japanese Patent Application Laid-Open No. 2014-197175 includes a developer regulating member made of resin, which is molded with resin, and a frame member of a developer container made of resin, which is molded with resin.

In association with an increase in the width of a sheet on which to form an image, the area of a coated amount regulating surface corresponding to an image region able to be formed on an image bearing member becomes larger, so that the length in the longitudinal direction of a regulating blade becomes larger. In a case where a regulating blade the length of which in the longitudinal direction thereof is large is molded with resin, it is difficult to ensure the straightness of the coated amount regulating surface of the regulating blade made of resin, which is molded with resin. This is because, when a regulating blade the length of which in the longitudinal direction thereof is large is molded with resin, variations are likely to occur in ratios in which thermally-expanded resin thermally contracts. Therefore, in the case of a regulating blade made of resin, as the length in the longitudinal direction of the regulating blade becomes larger, due to the straightness of the coated amount regulating surface of the regulating blade, the SB gap G tends to become more likely to vary in the longitudinal direction of the developer bearing member. If the SB gap G varies in the longitudinal direction of the developer bearing member, variations in the longitudinal direction of the developer bearing member may occur in the amount of a developer to be borne on the surface of the developer bearing member.

Therefore, in a development device equipped with a regulating blade made of resin, it is desirable that the SB gap G be within a predetermined range over the longitudinal direction of the developer bearing member in a state that the regulating blade is fixed to a blade attaching portion of the development frame member, irrespective of the straightness of the coated amount regulating surface of the regulating blade.

SUMMARY OF THE INVENTION

Aspects of the present invention are generally directed to providing a method of fixing a regulating blade and a development device in each of which, even when a regulating blade made of resin the straightness of a regulating portion of which is low is used, a gap between a developer bearing member and the regulating portion be within a predetermined range over the longitudinal direction of the developer bearing member in a state that the regulating blade is fixed to a blade attaching portion of a development frame member.

According to an aspect of the present invention, there is provided a method of fixing a regulating blade made of resin to an attaching portion of a development frame member made of resin, the attaching portion being used to attach the regulating blade, the regulating blade being arranged in non-contact with a developer bearing member, which bears a developer to develop an electrostatic latent image formed on an image bearing member, in such a way as to face the developer bearing member and being configured to regulate an amount of the developer to be borne on the developer bearing member, the method of fixing the regulating blade including an impartment step of imparting, to the regulating blade, a force for warping the regulating blade in such a manner that a gap between the developer bearing member supported by the development frame member and the regulating blade attached to the attaching portion falls within a predetermined range over a longitudinal direction of the developer bearing member, and a fixation step of fixing the regulating blade to the attaching portion in a state in which the regulating blade is warped by the force imparted to the regulating blade in the impartment step and the gap is within the predetermined range over the longitudinal direction of the developer bearing member.

According to another aspect of the present invention, a development device includes a developer bearing member configured to bear a developer to develop an electrostatic latent image formed on an image bearing member, a regulating blade made of resin arranged in non-contact with the developer bearing member in such a way as to face the developer bearing member and configured to regulate an amount of the developer to be borne on the developer bearing member, and a development frame member made of resin including an attaching portion used to attach the regulating blade, wherein the regulating blade includes a force receiving portion which externally receives a force for warping the regulating blade in such a manner that a gap between the developer bearing member supported by the development frame member and the regulating blade attached to the attaching portion falls within a predetermined range over a longitudinal direction of the developer bearing member, and is fixed to the attaching portion in a state in which the regulating blade is warped by the force received by the force receiving portion and the gap is within the predetermined range over the longitudinal direction of the developer bearing member.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings. Furthermore, the following exemplary embodiments should not be construed to limit the invention set forth in claims, and not all of the combinations of features described in a first exemplary embodiment of the invention are necessarily essential for solutions in the invention. The invention can be implemented for various use applications, such as printers, various types of printing machines, copying machines, facsimile apparatuses, and multifunction peripherals.

<Configuration of Image Forming Apparatus>

Figure 1:
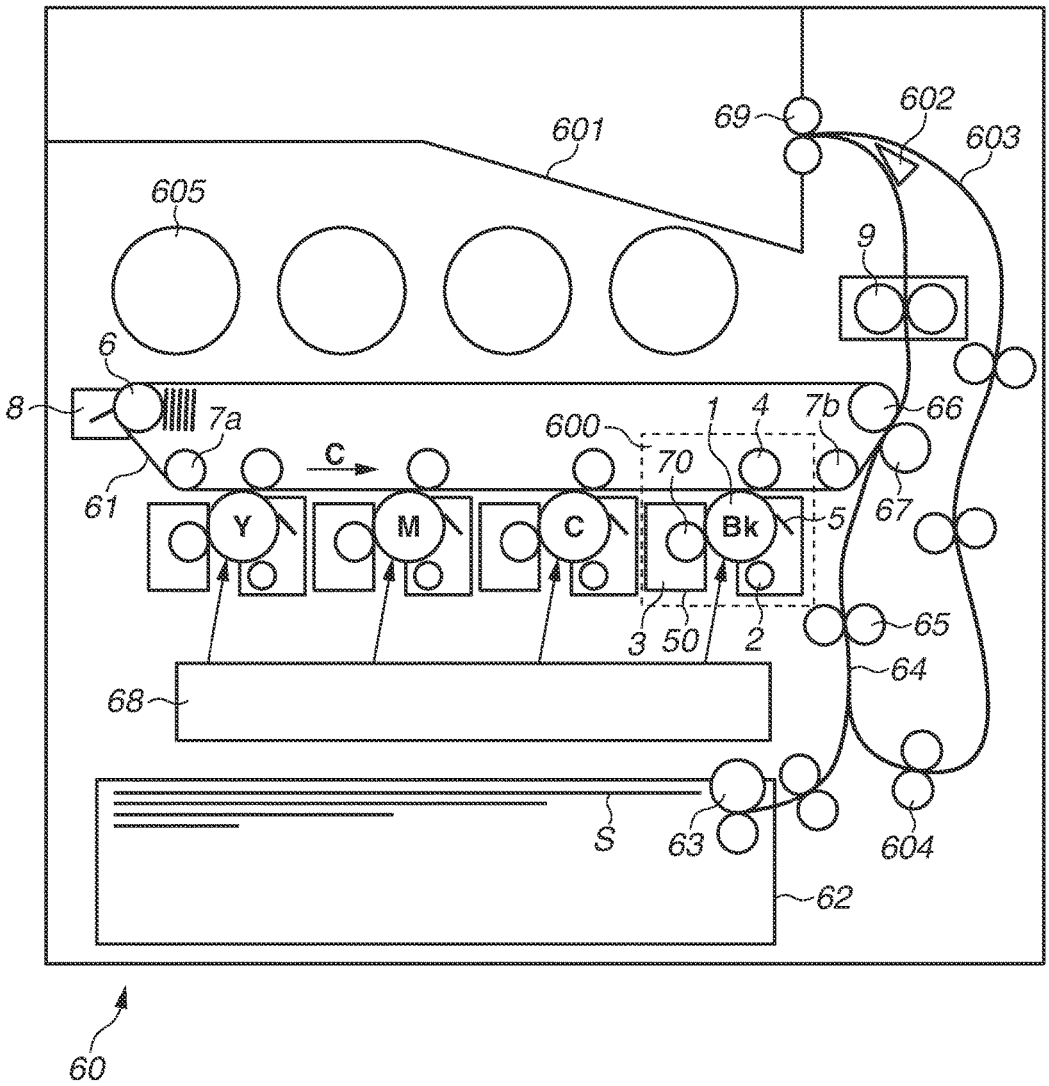
FIG. 1 is a sectional view illustrating a configuration of an image forming apparatus.

First, a configuration of an image forming apparatus according to the first exemplary embodiment of the invention is described with reference to the sectional view of FIG. 1. As illustrated in FIG. 1, the image forming apparatus 60 includes four image forming units 600 arranged from the upstream side to the downstream side along an endless intermediate transfer belt (ITB) 61, serving as an intermediate transfer member, and along the rotational direction of the intermediate transfer belt 61 (the direction of arrow C in FIG. 1). The image forming units 600 form images of the respective colors, yellow (Y), magenta (M), cyan (C), and black (Bk).

Each image forming unit 600 includes a rotatable photosensitive drum 1, which serves as an image bearing member. Moreover, each image forming unit 600 further includes a charging roller 2 serving as a charging unit, a development device 3 serving as a development unit, a primary transfer roller 4 serving as a primary transfer unit, and a photosensitive member cleaner 5 serving as a photosensitive member cleaning unit, which are arranged along the rotational direction of the photosensitive drum 1.

Each development device 3 is detachably attached to the image forming apparatus 60. Each development device 3 includes a developer container 50, which contains a two-component developer (hereinafter referred to simply as a "developer") including non-magnetic toner (hereinafter referred to simply as "toner") and magnetic carrier. Moreover, toner cartridges in which toners of respective colors, Y, M, C, and Bk, are respectively contained are detachably attached to the image forming apparatus 60. Toners of respective colors, Y, M, C, and Bk, are supplied to the respective developer containers 50 via toner conveyance paths. Furthermore, details of the development device 3 are described below with reference to FIG. 2 to FIG. 4, and details of the developer container 50 are described below with reference to FIG. 5.

The intermediate transfer belt 61 is supported by a tension roller 6, a driven roller 7*a*, a primary transfer roller 4, a driven roller 7*b*, and a secondary transfer inner roller 66 to extend in a tensioned state, and is driven to be conveyed in the direction of arrow C in FIG. 1. The secondary transfer inner roller 66 also serves as a driving roller used to drive the intermediate transfer belt 61. In conjunction with rotation of the secondary transfer inner roller 66, the intermediate transfer belt 61 rotates in the direction of arrow C in FIG. 1.

The intermediate transfer belt 61 is pressed by the primary transfer roller 4 from the back side of the intermediate transfer belt 61. Moreover, the intermediate transfer belt 61 abutting on the photosensitive drum 1 forms a primary transfer nip portion serving as a primary transfer portion between the photosensitive drum 1 and the intermediate transfer belt 61.

An intermediate transfer member cleaner 8 serving as a belt cleaning unit abuts on a position opposite to the tension roller 6 via the intermediate transfer belt 61. Moreover, a secondary transfer outer roller 67 serving as a secondary transfer unit is arranged at a position opposite to the secondary transfer inner roller 66 via the intermediate transfer belt 61. The intermediate transfer belt 61 is sandwiched between the secondary transfer inner roller 66 and the secondary transfer outer roller 67. With this, a secondary transfer nip portion serving as a secondary transfer portion is formed between the secondary transfer outer roller 67 and the intermediate transfer belt 61. At the secondary transfer nip portion, imparting a predetermined pressure and a predetermined transfer bias (electrostatic load bias) causes a toner image to adhere to the surface of a sheet S (for example, paper or plastic film).

Sheets S are stored in the state of being stacked in a sheet storing portion 62 (for example, a feed cassette or a feed deck). A feed unit 63 feeds a sheet S in conformity with image forming timing with use of, for example, a friction separation method using, for example, a feed roller. The sheet S fed by the feed unit 63 is conveyed to a registration roller 65, which is located on the way of a conveyance path 64. After being subjected to skew correction and timing correction at the registration roller 65, the sheet S is conveyed to the secondary transfer nip portion. At the secondary transfer nip portion, the sheet S and the toner image coincide in timing with each other, so that secondary transfer is performed.

A fixing device 9 is arranged at the more downstream side in the conveyance direction of the sheet S than the secondary transfer nip portion. Imparting a predetermined pressure and a predetermined amount of heat from the fixing device 9 to the sheet S conveyed to the fixing device 9 causes the toner image to be fused and fixed onto the surface of the sheet S. The sheet S with an image fixed thereto in this way is directly discharged to a discharge tray 601 according to the forward rotation of a discharge roller 69.

In the case of performing two-sided image formation, after the sheet S is conveyed until the trailing edge of the sheet S passes through a diverter 602 according to the forward rotation of the discharge roller 69, the discharge roller 69 is rotated backward. With this, the leading and trailing edges of the sheet S are switched, so that the sheet S is conveyed to a two-sided conveyance path 603. After that, in conformity with next image forming timing, the sheet S is re-conveyed by a re-feed roller 604 to the conveyance path 64.

<Image Forming Process>

During image formation, the photosensitive drum 1 is driven to rotate by a motor. The charging roller 2 uniformly charges the surface of the photosensitive drum 1, which is being driven to rotate, in advance. An exposure device 68 forms an electrostatic latent image on the surface of the photosensitive drum 1 charged by the charging roller 2, based on a signal of image information input to the image forming apparatus 60. The photosensitive drum 1 allows a plurality of sizes of electrostatic latent images to be formed thereon.

The development device 3 includes a rotatable developing sleeve 70, which serves a developer bearing member that bears (e.g. carries) a developer. The development device 3 develops an electrostatic latent image formed on the surface of the photosensitive drum 1 with use of a developer borne (e.g. carried) on the surface of the developing sleeve 70. With this, toner adheres to an exposure portion on the surface of the photosensitive drum 1, so that a visible image appears thereon. A transfer bias (electrostatic load bias) is imparted to the primary transfer roller 4, so that a toner image formed on the surface of the photosensitive drum 1 is transferred onto the intermediate transfer belt 61. Toner slightly remaining on the surface of the photosensitive drum 1 after primary transfer (transfer residual toner) is recovered by the photosensitive member cleaner 5, and is then re-prepared for a next image formation process.

Image formation processes for respective colors, which are parallelized by the image forming units 600 for respective colors, Y, M, C, and Bk, are performed at timing in which a next toner image is sequentially superposed on a toner image for the upstream color primarily transferred on the intermediate transfer belt 61. As a result, a full-color toner image is formed on the intermediate transfer belt 61, so that the toner image is conveyed to the secondary transfer nip portion. A transfer bias is imparted to the secondary transfer outer roller 67, so that the toner image formed on the intermediate transfer belt 61 is transferred to the sheet S conveyed to the secondary transfer nip portion. Toner slightly remaining on the intermediate transfer belt 61 after the sheet S passes through the secondary transfer nip portion (transfer residual toner) is recovered by the intermediate transfer member cleaner 8. The fixing device 9 fixes the toner image transferred onto the sheet S. The sheet (recording medium) S subjected to fixing processing by the fixing device 9 is discharged to the discharge tray 601.

The above-described series of operations of an image forming process ends, and a next image forming operation is prepared.

<Configuration of Development Device>

Next, a configuration of the development device 3 according to the first exemplary embodiment of the invention is described with reference to the perspective view of FIG. 2, the perspective view of FIG. 3, and the sectional view of FIG. 4. FIG. 4 is a sectional view of the development device 3 illustrating a cross-section H in FIG. 2.

The development device 3 includes a developer container 50 configured with a development frame member made of resin, which is molded with resin (hereinafter referred to simply as a "development frame member 30"), and a cover frame member made of resin, which is molded with resin (hereinafter referred to simply as a "cover frame member 40"), which is formed separately from the development frame member 30. FIG. 2 and FIG. 4 illustrate a state in which the cover frame member 40 is attached to the development frame member 30, and FIG. 3 illustrates a state in which the cover frame member 40 is not attached to the development frame member 30. Furthermore, details of the configuration of the development frame member 30 (single body) are described below with reference to FIG. 5.

The developer container 50 is provided with an aperture at a position equivalent to a development region in which the developing sleeve 70 faces the photosensitive drum 1. The developing sleeve 70 is arranged to be rotatable relative to the developer container 50 in such a manner that a part of the developing sleeve 70 is exposed on the aperture of the developer container 50. A bearing 71 serving as a bearing member is provided at each of both end portions of the developing sleeve 70.

The inside of the developer container 50 is sectioned by a partition wall 38, which extends in vertical direction, into a development chamber 31 serving as a first chamber and an agitation chamber 32 serving as a second chamber. The development chamber 31 and the agitation chamber 32 are connected with each other at both ends in the longitudinal direction thereof via communication portions 39 provided at two locations of the partition wall 38. Therefore, a developer is allowed to be transmitted between the development chamber 31 and the agitation chamber 32 via the communication portions 39. The development chamber 31 and the agitation chamber 32 are arranged horizontally side by side with respect to the horizontal direction.

A magnet roll having a plurality of magnetic poles along the rotational direction of the developing sleeve 70 and serving as a magnetic field generation unit that generates a magnetic field for causing the surface of the developing sleeve 70 to bear (e.g. carry) a developer thereon is fixedly arranged inside the developing sleeve 70. A developer in the development chamber 31 is drawn up under the influence of a magnetic field caused by the magnetic poles of the magnet roll, and is thus supplied to the developing sleeve 70. Since a developer is supplied from the development chamber 31 to the developing sleeve 70 in this way, the development chamber 31 is also referred to as a "supply chamber".

Inside the development chamber 31, a first conveyance screw 33, which serves as a conveyance unit that agitates a developer in the development chamber 31 and conveys the developer, is arranged opposite the developing sleeve 70. The first conveyance screw 33 includes a rotation shaft **33*a*, which serves as a rotatable shaft portion, and a spiral blade portion 33***b*, which serves as a developer conveyance portion, provided along the outer circumference of the rotation shaft 33*a*, and is supported in such a way as to be rotatable relative to the developer container 50. A bearing member is provided at each of both end portions of the rotation shaft 33*a*.

Moreover, inside the agitation chamber 32, a second conveyance screw 34, which serves as a conveyance unit that agitates a developer in the agitation chamber 32 and conveys the developer in a direction opposite to that of the first conveyance screw 33, is arranged. The second conveyance screw 34 includes a rotation shaft 34*a*, which serves as a rotatable shaft portion, and a spiral blade portion 34*b*, which serves as a developer conveyance portion, provided along the outer circumference of the rotation shaft 34*a*, and is supported in such a way as to be rotatable relative to the developer container 50. A bearing member is provided at each of both end portions of the rotation shaft 34*a*. Then, when the first conveyance screw 33 and the second conveyance screw 34 are driven to rotate, a developer is caused to circulate between the development chamber 31 and the agitation chamber 32 via the communication portions 39.

A regulating blade, which serves as a developer regulating member that regulates the amount of a developer borne on the surface of the developing sleeve 70 (also referred to as a "developer coated amount") (hereinafter referred to as a "doctor blade 36"), is attached to the developer container 50 while being arranged opposite the surface of the developing sleeve 70 in a non-contact manner therewith. The doctor blade 36 has a coated amount regulating surface 36*r* (i.e. regulating portion or regulating surface), which serves as a regulating portion used to regulate the amount of a developer borne on the surface of the developing sleeve 70. The doctor blade 36 is a doctor blade made of resin, which is molded with resin. Furthermore, a configuration of the doctor blade 36 (single body) is described below with reference to FIG. 6.

The doctor blade 36 is arranged opposite the developing sleeve 70 via a predetermined gap (hereinafter referred to as an "SB gap G") between the doctor blade 36 and the developing sleeve 70 over the longitudinal direction of the developing sleeve 70 (i.e., a direction parallel to the direction of a rotational axis of the developing sleeve 70). That is, for example, the predetermined gap separates the doctor blade 36 and the developing sleeve 70. Preferably, the predetermined gap separates the doctor blade 36 from the developing sleeve 70 by a fixed amount along the length of the doctor blade 36. It will be appreciated that the length axis of the doctor blade 36 is preferably parallel with the length of the axis of the developing sleeve 70. The developing sleeve 70 is preferably arranged to rotate about its length axis. In the context of the present specification, the SB gap G preferably refers to the shortest distance between a region corresponding to a maximum image region which the developing sleeve 70 is able to form on the surface of the photosensitive drum 1 (in other words, a maximum image region of the developing sleeve 70) and a region of the doctor blade 36 corresponding to the maximum image region (in other words, a maximum image region of the doctor blade 36). In the first exemplary embodiment, since the photosensitive drum 1 is allowed to form a plurality of sizes of electrostatic latent images thereon, the maximum image region is assumed to refer to an image region corresponding to the largest size (for example, A3 size) among a plurality of sizes of electrostatic latent images able to be formed on the photosensitive drum 1. On the other hand, in a modification example in which the photosensitive drum 1 is allowed to form only one size of electrostatic latent image thereon, the maximum image region is assumed to instead refer to an image region corresponding to only one size of image able to be formed on the photosensitive drum 1.

The doctor blade 36 may be arranged approximately/substantially opposite the peak position of a magnetic flux density of magnetic poles of the magnet roll. A developer supplied to the developing sleeve 70 is affected by a magnetic field caused by the magnetic poles of the magnet roll. Moreover, a developer regulated and scraped by the doctor blade 36 tends to stagnate (e.g. decay) at the upstream portion of the SB gap G. As a result, a developer stagnation is formed at the more upstream side in the rotational direction of the developing sleeve 70 than the doctor blade 36. That is, the amount of developer at the ends of the development sleeve 70 may be reduced (as compared to the center of the development sleeve 70) as a result of the doctor blade scraping the development sleeve 70. The doctor blade scrapes the development sleeve 70 to regulate the amount of developer on it. Consequently, a partial developer of the developer stagnation is conveyed in such a way as to pass through the SB gap G according to the rotation of the developing sleeve 70. At this time, the layer thickness of a developer passing through the SB gap G is regulated by the coated amount regulating surface 36*r* of the doctor blade 36. In this way, a thin layer of developer is formed on the surface of the developing sleeve 70.

Then, a predetermined amount of developer borne on the surface of the developing sleeve 70 is conveyed to a development region according to the rotation of the developing sleeve 70. Therefore, adjusting the size of the SB gap G leads to adjusting the amount of a developer to be conveyed to the development region. In the first exemplary embodiment, a size of the SB gap G targeted to adjust the size of the SB gap G (in other words, a target value of the SB gap G) is set to about 300 micrometers (μm).

The developer conveyed to the development region is magnetically lifted at the development region, so that a magnetic brush is formed. The magnetic brush contacting the photosensitive drum 1 causes toner contained in the developer to be supplied to the photosensitive drum 1. Then, an electrostatic latent image formed on the surface of the photosensitive drum 1 is developed as a toner image. A developer on the surface of the developing sleeve 70 remaining after passing the development region and supplying toner to the photosensitive drum 1 (hereinafter referred to as a "developer after development process") is peeled from the surface of the developing sleeve 70 by a repulsive magnetic field formed between magnetic poles of the same polarity of the magnet roll. The developer after development process peeled from the surface of the developing sleeve 70 falls in the development chamber 31, thus being recovered into the development chamber 31.

As illustrated in FIG. 4, the development frame member 30 is provided with a developer guide portion 35 for guiding a developer in such a manner that the developer is conveyed toward the SB gap G. The developer guide portion 35 and the development frame member 30 are configured to be integrally formed, and the developer guide portion 35 and the doctor blade 36 are configured to be separately formed. The developer guide portion 35 is formed inside the development frame member 30, and is arranged at the more upstream side in the rotational direction (i.e. in the anti-clockwise direction as viewed in FIG. 4) of the developing sleeve 70 than the coated amount regulating surface 36*r* of the doctor blade 36. The flow of a developer is stabilized by the developer guide portion 35 to make adjustment to obtain a predetermined developer density, so that the weight of a developer at a position in which the coated amount regulating surface 36*r* of the doctor blade 36 is in most proximity to the surface of the developing sleeve 70 can be defined.

Moreover, as illustrated in FIG. 4, the cover frame member 40 is formed separately from the development frame member 30 and is attached to the development frame member 30. Additionally, the cover frame member 40 covers a part of the aperture of the development frame member 30 in such a manner that a part of the outer circumferential surface of the developing sleeve 70 is covered over the entirety in the longitudinal direction of the developing sleeve 70. At this time, the cover frame member 40 covers a part of the aperture of the development frame member 30 in such a manner that a development region facing the photosensitive drum 1 of the developing sleeve 70 is exposed. While, in the first exemplary embodiment, the cover frame member 40 is fixed to the development frame member 30 by ultrasonic adhesion, the method of fixing the cover frame member 40 to the development frame member 30 can be any method, such as screw fastening, snap fit, adhesion, or welding.

Figure 5:
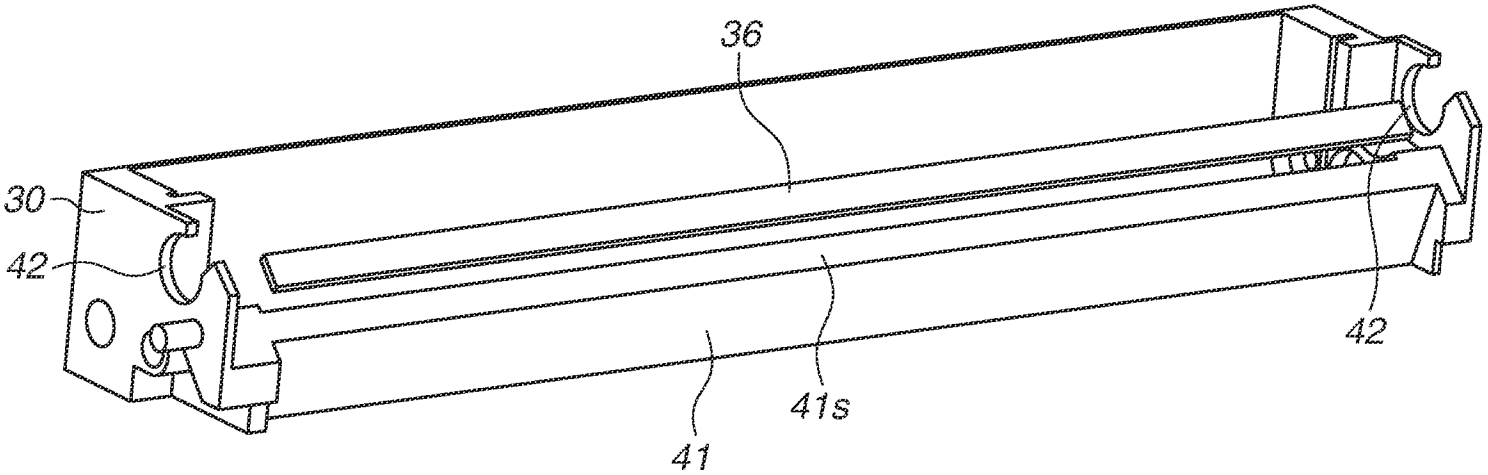
FIG. 5 is a perspective view illustrating a configuration of a development frame member (single body) made of resin.

Next, a configuration of the development frame member 30 (single body) is described with reference to the perspective view of FIG. 5. FIG. 5 illustrates a state in which the cover frame member 40 is not attached to the development frame member 30.

The development frame member 30 includes the development chamber 31 and the agitation chamber 32, which is separated from the development chamber 31 via the partition wall 38 (see FIG. 4). The partition wall 38 is molded with resin, and can be configured to be formed separately from the development frame member 30 or can be formed integrally with the development frame member 30.

Figure 3:
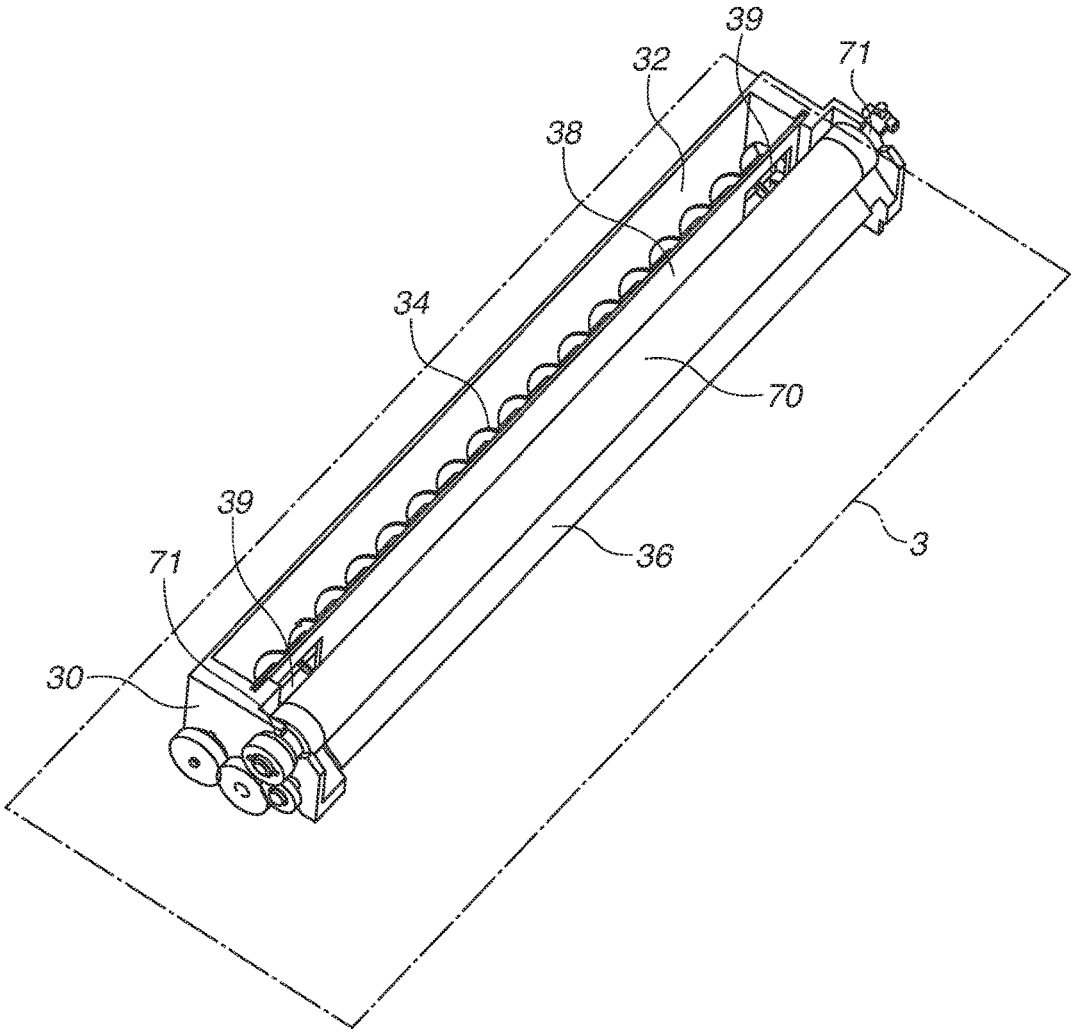
FIG. 3 is a perspective view illustrating the configuration of the development device according to the first exemplary embodiment.
Figure 4:
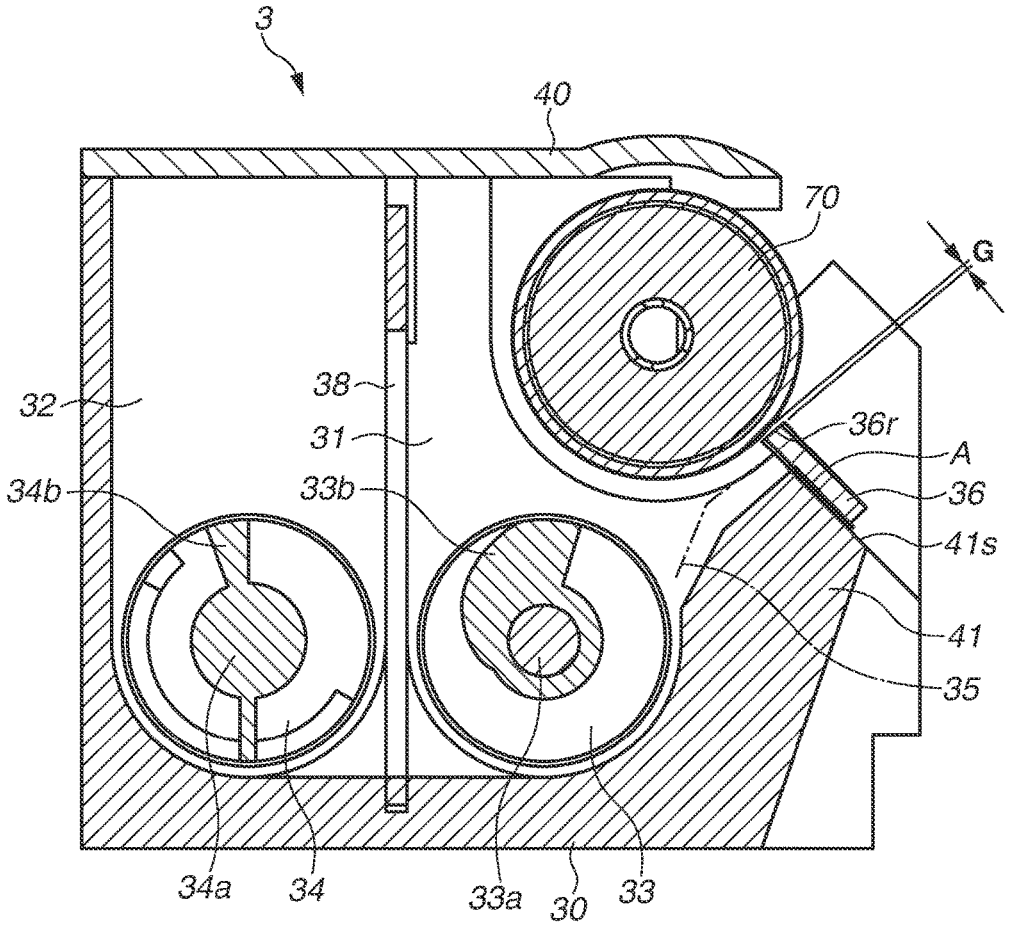
FIG. 4 is a sectional view illustrating the configuration of the development device according to the first exemplary embodiment.

The development frame member 30 has sleeve supporting portions 42 configured to support the developing sleeve 70 in such a way as to allow the developing sleeve 70 to rotate by supporting bearings 71 respectively provided at both end portions of the developing sleeve 70 (see FIGS. 3, 4 and 5). Moreover, the development frame member 30 has a blade attaching portion 41 (which is formed integrally with the sleeve supporting portions 42) to which the doctor blade 36 is attached. FIG. 5 illustrates a virtual state in which the doctor blade 36 floats above the blade attaching portion 41.

In the first exemplary embodiment, with the doctor blade 36 attached to the blade attaching portion 41, an adhesive A applied to a blade attaching surface 41*s* of the blade attaching portion 41 becomes hardened, so that the doctor blade 36 is fixed to the blade attaching portion 41 (See FIG. 4). Details of the method of fixing the doctor blade 36 to the blade attaching portion 41 are described below with reference to FIG. 9 and subsequent figures.

<Doctor Blade Made of Resin>

According to an increase in the width of the sheet S on which an image is to be formed, for example, the width of the sheet S being A3 size, the area of a coated amount regulating surface corresponding to the maximum image region able to be formed on the surface of the photosensitive drum 1 becomes larger, so that the length in the longitudinal direction of a doctor blade becomes larger.

In a case where the length of the doctor blade (note the length extends along the longitudinal axis of the doctor blade) is large, and the doctor blade is molded with resin, it is difficult to ensure the straightness/uniformity of the blade with a coated amount regulating surface provided for the doctor blade made of resin, which is molded with resin. This is because, when a doctor blade the length in the longitudinal direction of which is large is molded with resin, variations are likely to occur in ratios in which thermally-expanded resin thermally contracts. Furthermore, the straightness of a coated amount regulating surface is represented by the absolute value of a difference between the maximum value and minimum value of the outer shape of a coated amount regulating surface based on a predetermined location on the coated amount regulating surface in the longitudinal direction of the coated amount regulating surface. For example, suppose that a central portion of the coated amount regulating surface in the longitudinal direction of the coated amount regulating surface is set as the origin, a predetermined straight line passing through the origin is set as the X-axis, and a straight line drawn from the origin in a direction perpendicular to the X-axis is set as the Y-axis. In this orthogonal coordinate system, the straightness of a coated amount regulating surface is represented by the absolute value of a difference between the maximum value and minimum value of the Y-coordinate of the outer shape of the coated amount regulating surface.

For example, in a case where a doctor blade made of resin the length in the longitudinal direction of which is a length corresponding to A3 size (hereinafter referred to as a "doctor blade made of resin compatible with A3 size") is manufactured with the accuracy of a general resin product, the straightness of a coated amount regulating surface is approximately 300 μm to 500 μm. Moreover, even if the doctor blade made of resin compatible with A3 size is manufactured with a high degree of accuracy with use of a high-precision resin material, the straightness of a coated amount regulating surface is approximately 100 μm to 200 μm.

Therefore, in the case of a doctor blade made of resin, as the length in the longitudinal direction of the doctor blade become larger, the SB gap is more likely to vary along the longitudinal direction (i.e. along the longitudinal axis) of the developer bearing member due to the straightness of a coated amount regulating surface—e.g. the size of the SB gap separating the doctor blade from the development sleeve may vary along the length (i.e. along the longitudinal axis) of the development sleeve/doctor blade due to variations/non-uniformities in the straightness of the doctor blade. In particular, unevenness in the straightness of the regulating surface of the doctor blade can cause variations in the size of the SB gap. If the SB gap varies in/along the longitudinal direction/axis of a developer bearing member, unevenness may occur in the amount of a developer to be borne on the surface of the developer bearing member in the longitudinal direction of the developer bearing member.

Therefore, in the first exemplary embodiment, to prevent or reduce unevenness in the amount of a developer to be borne on the surface of the developing sleeve 70 in/along the longitudinal direction/axis of the developing sleeve 70, the SB gap G is configured to be within a predetermined range over the longitudinal direction/axis of the developing sleeve 70. Specifically, in the first exemplary embodiment, the tolerance of the SB gap G (in other words, a tolerance of the SB gap G relative to a target value) is set to ±10% or less, so that the SB gap G falls within a predetermined range over the longitudinal direction of the developing sleeve 70.

In the first exemplary embodiment, a method described as follows is used to determine whether the SB gap G is within a predetermined range over the longitudinal direction of the developing sleeve 70. Furthermore, details of a method of measuring the SB gap G (calculation method) are described below with reference to FIG. 11.

First, an area corresponding to the maximum image region of the doctor blade 36 is divided into four or more locations at even intervals, and the SB gap G is measured at five or more locations in each of the divided locations of the doctor blade 36 (in this regard, including both end portions and a central portion of the area corresponding to the maximum image region of the doctor blade 36). Then, the maximum value of the SB gap G, the minimum value of the SB gap G, and the median value of the SB gap G are extracted from samples of measured values of the SB gap G measured at five or more locations. If (i) the absolute value of a difference between the maximum value of the SB gap G and the median value of the SB gap G is 10% or less of the median value of the SB gap G, and (ii) the absolute value of a difference between the minimum value of the SB gap G and the median value of the SB gap G is 10% or less of the median value of the SB gap G, then it is acceptable. In this case, the tolerance of the SB gap G is assumed to be ±10% or less and the SB gap G is assumed to satisfy being within a predetermined range over the longitudinal direction of the developing sleeve 70.

For example, in a case where the median value of the SB gap G is 300 μm based on samples of measured values of the SB gap G measured at five or more locations, if the maximum value of the SB gap G is 330 μm or less and the minimum value of the SB gap G is 270 μm or more, then it is acceptable. In other words, in this case, it is meant that the adjustment value of the SB gap G is 300 μm±30 μm and the allowable tolerance of the SB gap G is up to 60 μm. Therefore, even if a doctor blade made of resin compatible with A3 size is manufactured with the precision of a general resin product or can be manufactured with a high degree of accuracy with use of a high-precision resin material, the range allowable as the tolerance of the SB gap G would be exceeded only with the precision of the straightness of a coated amount regulating surface.

Therefore, in the case of a development device equipped with a doctor blade made of resin, the SB gap G is desired to be within a predetermined range over the longitudinal direction (i.e. over the longitudinal axis or length) of a developer bearing member in a state that the doctor blade is fixed to the blade attaching portion of the development frame member, regardless of the straightness of a coated amount regulating surface. The first exemplary embodiment employs a configuration described below in such a manner that, even when a doctor blade made of resin, in which the accuracy of the straightness of a coated amount regulating surface is low, is used, a gap between the developer bearing member and the doctor blade is made to be within a predetermined range over the longitudinal direction (i.e. over the longitudinal axis or length) of the developer bearing member in a state that the doctor blade is fixed to the blade attaching portion of the development frame member. Details thereof are described as follows.

First, a configuration of the doctor blade 36 (single body) is described with reference to the perspective view of FIG. 6.

During an image forming operation (development operation), the pressure of a developer (hereinafter referred to as "developer pressure"), which occurs due to the flow of the developer, is imparted to the doctor blade 36. As the rigidity of the doctor blade 36 is smaller, when the developer pressure is imparted to the doctor blade 36 during an image forming operation (development operation), the doctor blade 36 is more likely to become deformed, so that the size of the SB gap G is more likely to vary. During an image forming operation (development operation), the developer pressure is imparted in the widthwise direction of the doctor blade 36 (i.e. the direction of arrow M in FIG. 6, which is perpendicular to the length of the doctor blade 36). Therefore, to prevent or reduce variations in the size of the SB gap G in the process of an image forming operation (development operation), it is desirable that the rigidity in the widthwise direction of the doctor blade 36 be increased to strengthen the doctor blade 36 against deformation in the widthwise direction thereof.

Figure 6:
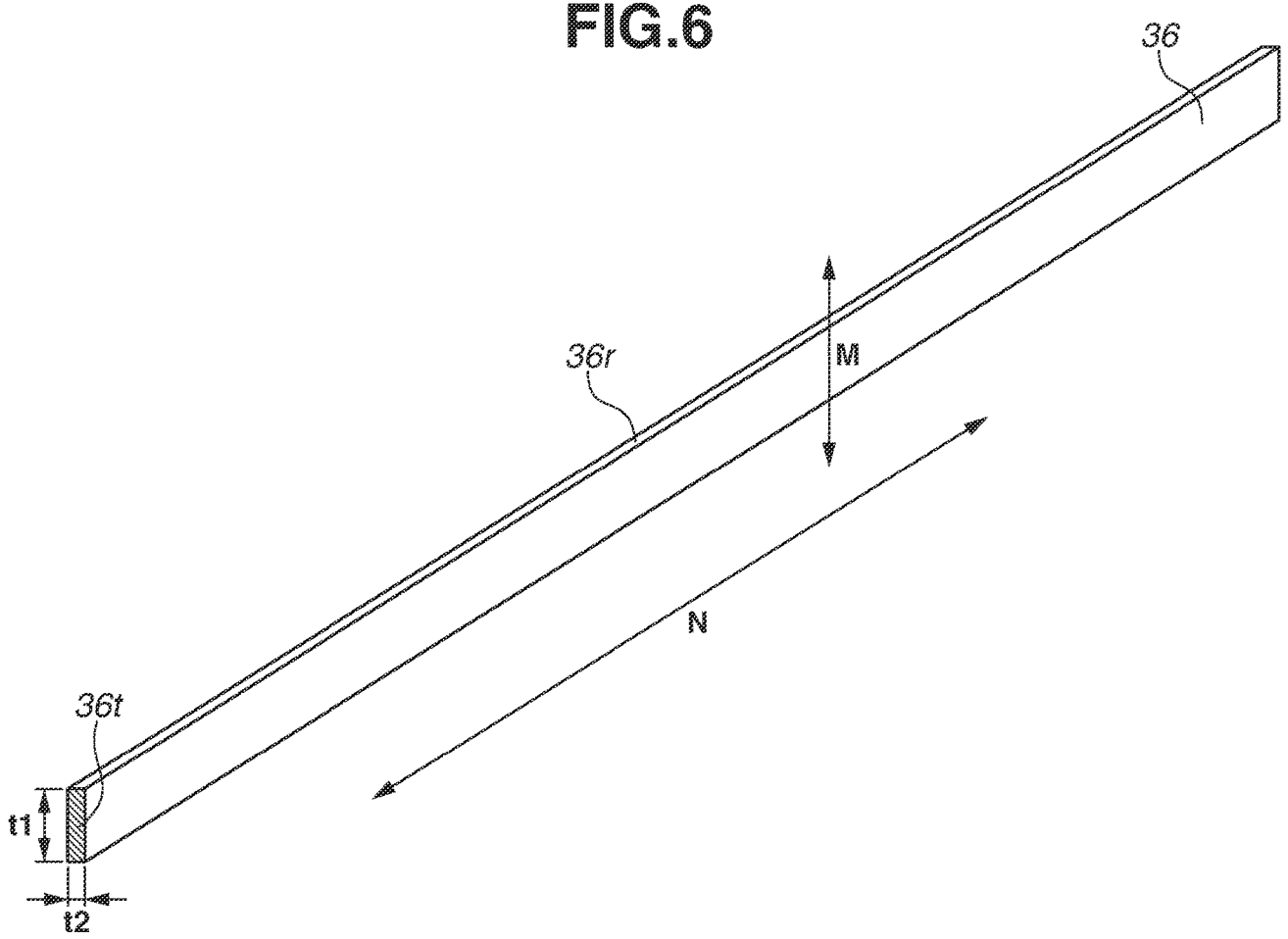
FIG. 6 is a perspective view illustrating a configuration of a doctor blade (single body) made of resin.

As illustrated in FIG. 6, in the first exemplary embodiment, the shape of the doctor blade 36 is made plate-like from the viewpoint of mass productivity and cost. Moreover, as illustrated in FIG. 6, in the first exemplary embodiment, the cross-sectional area of a side surface 36*t* of the doctor blade 36 is made small, and, additionally, the length t2 in the thickness direction of the doctor blade 36 is made smaller than the length t1 in the widthwise direction of the doctor blade 36 (i.e. the thickness t2 of the doctor blade 36 is made smaller than the width t1 of the doctor blade 36). With this, the doctor blade 36 (single body) is configured to easily deform in a direction (the direction of arrow M in FIG. 6) perpendicular to the longitudinal direction of the doctor blade 36 (the direction of arrow N in FIG. 6)—i.e. the doctor blade is configured to preferably deform along the widthwise axis of the doctor blade 36). Therefore, to correct the straightness of the coated amount regulating surface 36*r*, the first exemplary embodiment employs a method of fixing the doctor blade 36 to the blade attaching portion 41 of the development frame member 30 in a state in which at least a part of the doctor blade 36 is warped in/along the direction of arrow M in FIG. 6. Furthermore, details of the method of fixing the doctor blade 36 to the blade attaching portion 41 of the development frame member 30 (hereinafter referred to as a "fixation method for the doctor blade 36") are described below with reference to FIG. 9 and subsequent figures.

Next, the rigidity of the doctor blade 36 (single body) is described with reference to the schematic view of FIG. 7. The rigidity of the doctor blade 36 (single body) is measured in a state in which the doctor blade 36 is not fixed to the blade attaching portion 41 of the development frame member 30.

Figure 7:
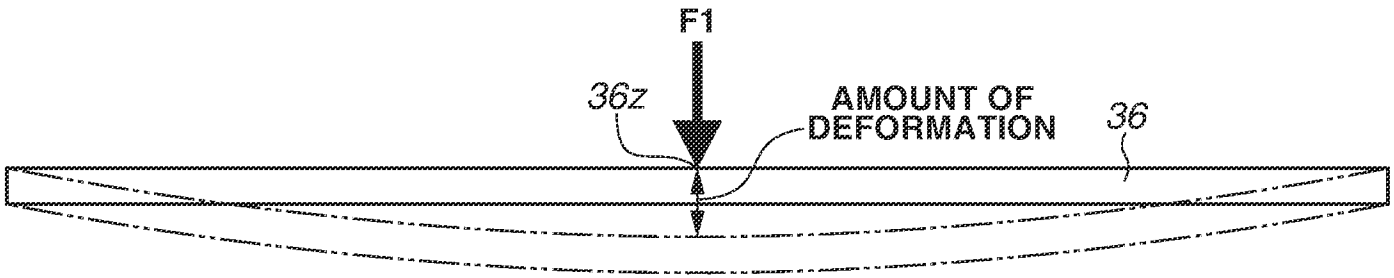
FIG. 7 is a schematic diagram used to explain the rigidity of the doctor blade (single body) made of resin.

As illustrated in FIG. 7, a concentrated load F1 is imparted in the widthwise direction of the doctor blade 36 to a central portion 36*z* of the doctor blade 36 as viewed in the longitudinal direction of the doctor blade 36. At this time, the rigidity of the doctor blade 36 (single body) is measured based on the amount of warp in the widthwise direction of the doctor blade 36 at the central portion 36*z* of the doctor blade 36.

For example, suppose that a concentrated load F1 of 300 gram-force (gf) is imparted in the widthwise direction of the doctor blade 36 to the central portion 36*z* of the doctor blade 36 as viewed in the longitudinal direction of the doctor blade 36 (i.e. load F1 is applied to the central portion 36*z* of the doctor blade 36 and the central portion 36*z* is located in the middle of the doctor blade's length). At this time, the amount of warp in the widthwise direction of the doctor blade 36 at the central portion 36*z* of the doctor blade 36 is 700 μm or more. Furthermore, at this time, the amount of deformation of the central portion 36*z* of the doctor blade 36 on the cross-section is 5 μm or less. It will be noted that the amount of warp/deformation is preferably determined relative to when no force is applied to the doctor blade 36.

Next, the rigidity of the development frame member 30 (single body) is described with reference to the schematic view of FIG. 8. The rigidity of the development frame member 30 (single body) is measured in a state in which the doctor blade 36 is not fixed to the blade attaching portion 41 of the development frame member 30.

Figure 8:
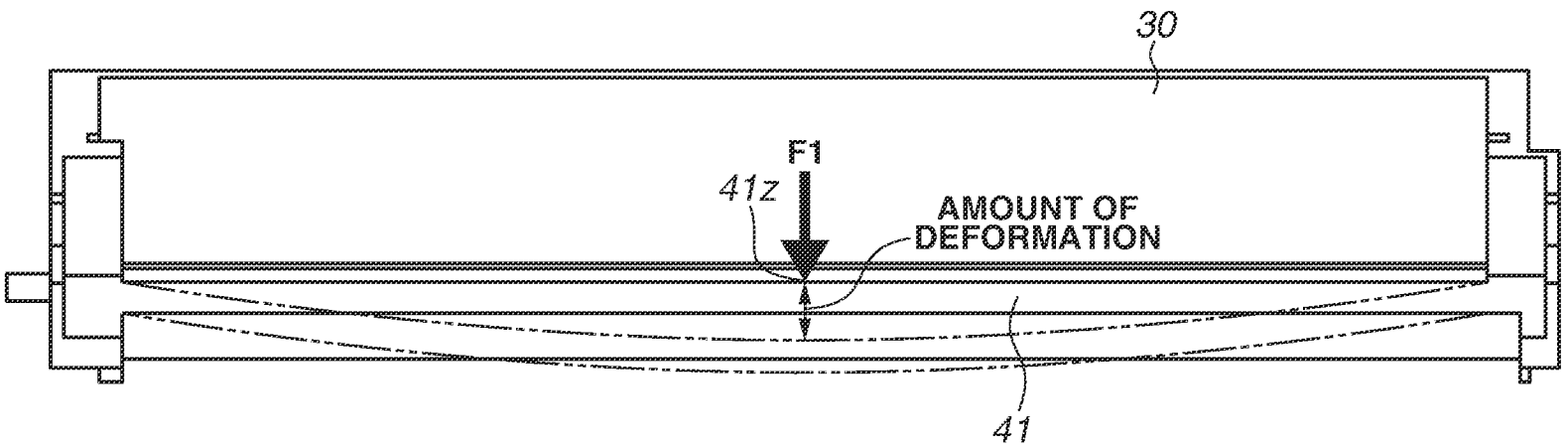
FIG. 8 is a schematic diagram used to explain the rigidity of the development frame member (single body) made of resin.

As illustrated in FIG. 8, a concentrated load F1 is imparted in the widthwise direction of the blade attaching portion 41 to a central portion 41*z* of the blade attaching portion 41 as viewed in the longitudinal direction of the blade attaching portion 41. At this time, the rigidity of the development frame member 30 (single body) is measured based on the amount of warp in the widthwise direction of the blade attaching portion 41 at the central portion 41*z* of the blade attaching portion 41.

For example, suppose that a concentrated load F1 of 300 gf is imparted in the widthwise direction of the blade attaching portion 41 to the central portion 41*z* of the blade attaching portion 41 as viewed in the longitudinal direction of the blade attaching portion 41. At this time, the amount of warp in the widthwise direction of the blade attaching portion 41 at the central portion 41*z* of the blade attaching portion 41 is 60 μm or less.

Suppose that the concentrated load F1 of the same magnitude is imparted to each of the central portion 36*z* of the doctor blade 36 and the central portion 41*z* of the blade attaching portion 41 of the development frame member 30. At this time, the amount of warp of the central portion 36*z* of the doctor blade 36 is 10 times or more the amount of warp of the central portion 41*z* of the blade attaching portion 41. Thus, the magnitude of the rigidity of the development frame member 30 (single body) is at least 10 times larger than the magnitude of the rigidity of the doctor blade 36 (single body). Therefore, in a state in which the doctor blade 36 is attached to the blade attaching portion 41 of the development frame member 30 so that the doctor blade 36 is fixed to the blade attaching portion 41 of the development frame member 30, the rigidity of the development frame member 30 becomes more dominant than the rigidity of the doctor blade 36.

Moreover, the magnitude of the rigidity of the development frame member 30 (single body) is larger than the magnitude of the rigidity of the cover frame member 40 (single body). Therefore, in a state in which the cover frame member 40 is attached to the development frame member so that the cover frame member 40 is fixed to the development frame member 30, the rigidity of the development frame member 30 becomes more dominant than the rigidity of the cover frame member 40.

<Fixation Method for Doctor Blade Made of Resin>

Each of steps of the fixation method for the doctor blade 36 is described with reference to the schematic views of FIG. 9 to FIG. 14. An external apparatus (hereinafter referred to simply as an "apparatus 100") performs each of steps of the fixation method for the doctor blade 36 described as follows.

First, the apparatus 100 detects the outer shape of the coated amount regulating surface 36*r* of the doctor blade 36. Next, the apparatus 100 recognizes the straightness of the coated amount regulating surface 36*r* based on a central portion of the coated amount regulating surface 36*r* (a front edge portion 36*e*3 of the doctor blade 36) with regard to the outer shape of the coated amount regulating surface 36*r* in the longitudinal direction of the coated amount regulating surface 36*r*. In the steps of the fixation method for the doctor blade 36, a doctor blade made of resin compatible with A3 size manufactured with the accuracy of a general resin product is used. Therefore, the apparatus 100 recognizes that the straightness of the coated amount regulating surface 36*r* is approximately 300 μm to 500 μm. Then, the apparatus 100 warps at least a part of the area corresponding to the maximum image region of the doctor blade 36 with a force imparted to the doctor blade 36. Then, the apparatus 100 corrects the straightness of the coated amount regulating surface 36*r* to 50 μm or less (hereinafter referred to as a "warping step").

Next, the apparatus 100 determines a position at which to fix the doctor blade 36, at least a part of the area corresponding to the maximum image region of which has been warped in the warping step, to the blade attaching portion 41 of the development frame member 30 so as to cause the SB gap G to fall within a predetermined range (hereinafter referred to as a "positioning step"). Next, in a state in which at least a part of the area corresponding to the maximum image region of the doctor blade 36 has been warped, the apparatus 100 fixes a part of the area corresponding to the maximum image region of the doctor blade 36 at a predetermined position of the blade attaching portion 41 determined in the positioning step (hereinafter referred to as a "fixation step").

The apparatus 100 includes a placement board 103 on which to place the doctor blade 36 (single body). Moreover, the apparatus 100 further includes fingers 101 (101*p*1 to 101*p*5) provided at five locations to grasp the respective grab portions 37 (37P1 to 37*p*5) provided at five locations in the area corresponding to the maximum image region of the doctor blade 36. Each of the fingers 101 (101*p*1 to 101*p*5) is independently movable along the direction J in FIG. 9, and is able to move forward and move backward with respect to the direction J in FIG. 9.

Moreover, the apparatus 100 further includes cameras 102 (102*p*1 to 102*p*5) provided at five locations to measure the respective positions of front edge portions 36*e* (36*e*1 to 36*e*5) provided at five locations included in the coated amount regulating surface 36*r* of the doctor blade 36. Each of the cameras 102 (102*p*1 to 102*p*5) is arranged along a direction toward a corresponding one of the front edge portions 36*e* (36*e*1 to 36*e*5) of the doctor blade 36 (the direction of arrow F in FIG. 9). Then, the cameras 102 (102*p*1 to 102*p*5) detect the outer shape of the coated amount regulating surface 36*r* of the doctor blade 36 by measuring the positions of the front edge portions 36*e* (36*e*1 to 36*e*5) of the doctor blade 36. Next, the apparatus 100 recognizes the straightness of the coated amount regulating surface 36*r* based on the central portion of the coated amount regulating surface 36*r* (the front edge portion 36*e*3 of the doctor blade 36) with regard to the outer shape of the coated amount regulating surface 36*r* in the longitudinal direction of the coated amount regulating surface 36*r*. Furthermore, while an example in which the measurement of the positions of the front edge portions 36*e* (36*e*1 to 36*e*5) of the doctor blade is performed by the cameras 102 (102*p*1 to 102*p*5) is hereinafter described, a modification example in which the measurement is performed by non-contact sensors can be employed.

The doctor blade 36 is manufactured with the precision of a general resin product. As mentioned above, in a case where the doctor blade made of resin compatible with A3 size is manufactured with the precision of a general resin product, the straightness of a coated amount regulating surface is approximately 300 μm to 500 μm. Suppose that the doctor blade 36 is a doctor blade made of resin compatible with A3 size which is manufactured with the precision of a general resin product. In this case, in a state in which the doctor blade 36 is placed on the placement board 103, when the positions of the front edge portions 36*e* (36*e*1 to 36*e*5) provided at five locations of the doctor blade 36 are measured by the cameras 102 (102*p*1 to 102*p*5), a difference of approximately 300 μm to 500 μm would be detected. On the other hand, as mentioned above, the tolerance of the SB gap G is set to ±10% or less so as to prevent or reduce unevenness in the amount of a developer to be borne on the surface of the developing sleeve 70 in the longitudinal direction of the developing sleeve 70.

Therefore, in view of, for example, the allowable value of the tolerance of the SB gap G or the attaching accuracy of the doctor blade 36 to the development frame member 30, the straightness of the front edge portions 36*e* (36*e*1 to 36*e*5) of the doctor blade 36 (in other words, the straightness of the coated amount regulating surface 36*r*) is required to be corrected to 50 μm or less. Furthermore, in view of the fact that the accuracy of the straightness of a doctor blade made of metal manufactured by secondary cutting work is 20 μm or less, it is more desirable that the straightness of the coated amount regulating surface 36*r* of the doctor blade 36 made of resin be corrected to 20 μm or less.

Next, details of a series of steps of the fixation method for the doctor blade 36 (a warping step, a positioning step, and a fixation step) are hereinafter described.

(1) Warping Step

First, details of the warping step are described with reference to the schematic view of FIG. 9. The apparatus 100 holds the doctor blade 36 by grasping the grab portions 37 (37P1 to 37*p*5) of the doctor blade 36 with the fingers 101 (101*p*1 to 101*p*5). Next, the cameras 102 (102*p*1 to 102*p*5) measure the positions of the front edge portions 36*e* (36*e*1 to 36*e*5) of the doctor blade 36 with the grab portions 37 (37P1 to 37*p*5) of the doctor blade 36 grasped with the fingers 101 (101*p*1 to 101*p*5). With this, the apparatus 100 detects the outer shape of the coated amount regulating surface 36*r* of the doctor blade 36. Next, the apparatus 100 recognizes the straightness of the coated amount regulating surface 36*r* based on the central portion of the coated amount regulating surface 36*r* (the front edge portion 36*e*3 of the doctor blade 36) with regard to the outer shape of the coated amount regulating surface 36*r* in the longitudinal direction of the coated amount regulating surface 36*r*.

Figure 9:
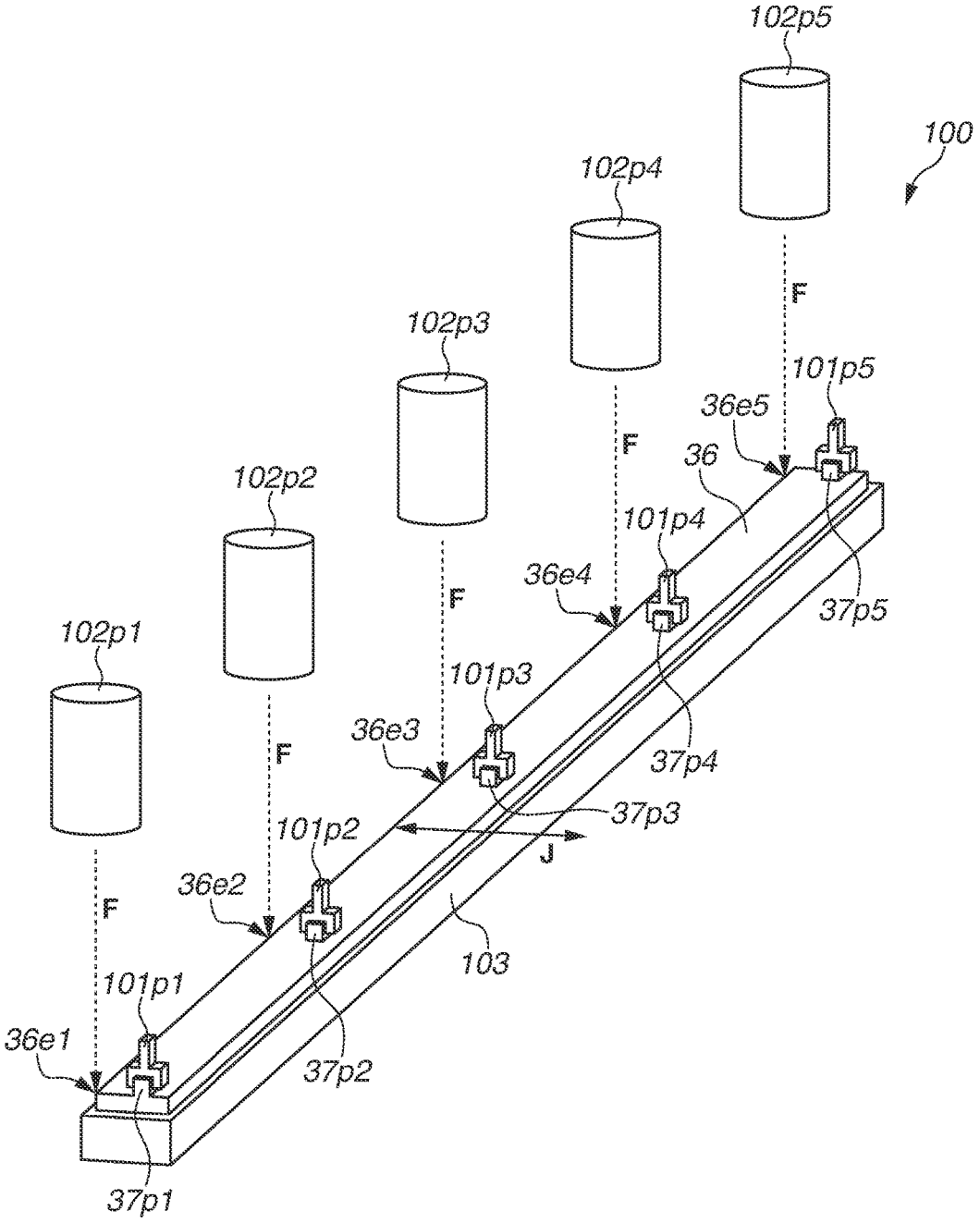
FIG. 9 is a schematic diagram used to explain steps of a method of fixing the doctor blade made of resin.

Then, the apparatus 100 moves each of the fingers 101 (101*p*1 to 101*p*5) in the direction J in FIG. 9 with the grab portions 37 (37P1 to 37*p*5) of the doctor blade 36 grasped with the fingers 101. With this, the apparatus 100 imparts, to the doctor blade 36, a force for warping at least a part of the area corresponding to the maximum image region of the doctor blade 36 via the grab portions 37 of the doctor blade 36 grasped with the fingers 101. Thus, the grab portions 37 of the doctor blade 36 function as a force receiving portion for receiving a force imparted from the apparatus 100 to the doctor blade 36 to warp at least a part of the area corresponding to the maximum image region of the doctor blade 36.

Figure 10:
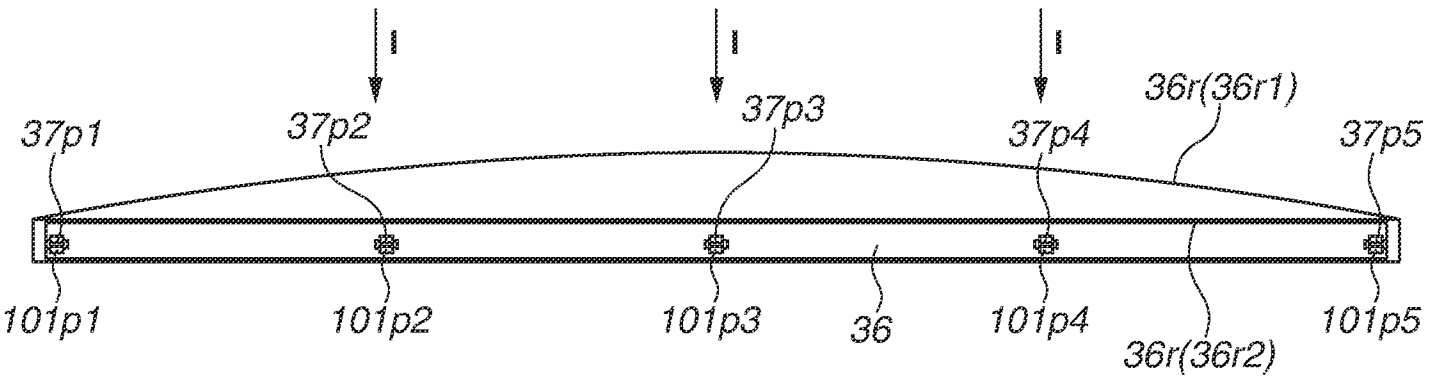
FIG. 10 is a schematic diagram used to explain steps of the method of fixing the doctor blade made of resin.

As illustrated in FIG. 10, the doctor blade 36 (single body) has such a shape that the central portion of the coated amount regulating surface 36*r* of the doctor blade 36 is greatly warped in/along the longitudinal direction of the doctor blade 36—that is the widthwise profile of the doctor blade 36 varies along the longitudinal axis/length of the doctor blade 36. Therefore, it is necessary to correct the straightness of the coated amount regulating surface 36*r* of the doctor blade 36 by reducing differences of positions of the front edge portions 36*e* (36*e*1 to 36*e*5) of the doctor blade 36. Thus, a method of reducing differences of positions of the front edge portions 36*e* (36*e*1 to 36*e*5) of the doctor blade 36 based on a result of detection of the positions of the front edge portions 36*e* (36*e*1 to 36*e*5) of the doctor blade 36 (the detected outer shape of the coated amount regulating surface 36*r*) is employed. For that purpose, the apparatus 100 corrects the straightness of the coated amount regulating surface 36*r* to 50 μm or less by imparting, to the doctor blade 36, a force for warping at least a part of the area corresponding to the maximum image region of the doctor blade 36 (hereinafter referred to as a "straightness correction force").

Next, the apparatus 100 grasps the grab portions (37P1 to 37*p*5) of the doctor blade 36 placed on the placement board 103 with the fingers 101 (101*p*1 to 101*p*5). Then, the apparatus 100 independently moves forward or moves backward each of the fingers 101 along the direction of arrow J in FIG. 9 while grasping the grab portions 37 (37P1 to 37*p*5) of the doctor blade 36 with the fingers 101 (101*p*1 to 101*p*5). At this time, the apparatus 100 imparts, to the doctor blade 36, a force for warping at least a part of the area corresponding to the maximum image region of the doctor blade 36 via the grab portions 37 of the doctor blade 36.

In the example illustrated in FIG. 10, the apparatus 100 sets the outer shapes of the front edge portions 36*e*1 and 36*e*5 of the doctor blade 36 as a base, and imparts a straightness correction force to the doctor blade 36 in such a way as to adjust the outer shapes of the front edge portions 36*e*2, 36*e*3, and 36*e*4 to the base. In the example illustrated in FIG. 10, the doctor blade 36 externally receives a force for warping at least a part of the area corresponding to the maximum image region of the doctor blade 36 via the grab portions 37 (37P2 to 37*p*4) provided at three locations among five locations. Then, with the force received by the doctor blade 36 via the grab portions 37 (37P2 to 37*p*4) provided at three locations, a straightness correction force for correcting the straightness of the coated amount regulating surface 36*r* is imparted to the front edge portions 36*e*2 to 36*e*4 of the doctor blade 36 in the direction of arrow I in FIG. 10. At this time, the straightness correction force is imparted to the coated amount regulating surface 36*r* and, thus, a part of the area corresponding to the maximum image region of the doctor blade 36 is warped, so that the straightness of the coated amount regulating surface 36*r* of the doctor blade 36 is corrected. In the example illustrated in FIG. 10, the shape of the coated amount regulating surface 36*r* of the doctor blade 36 is corrected from a coated amount regulating surface 36*r*1 to a coated amount regulating surface 36*r*2.

As a result, the straightness of the coated amount regulating surface 36*r* of the doctor blade 36 is able to be corrected to 50 μm or less. Furthermore, while, in the example illustrated in FIG. 10, the base used for the apparatus 100 to adjust the outer shape of the front edge portions 36*e* of the doctor blade 36 is set to the outer shapes of the front edge portions 36*e*1 and 36*e*5 of the doctor blade 36, a modification example in which the base is set to the outer shape of the front edge portion 36*e*3 (in other words, a central portion of the coated amount regulating surface 36*r*) can be employed. In this modification example, the apparatus 100 sets the outer shape of the front edge portion 36*e*3 of the doctor blade 36 as a base, and imparts a straightness correction force to the doctor blade 36 in such a way as to adjust the outer shapes of the front edge portions 36*e*1, 36*e*2, 36*e*4, and 36*e*5 to the base. Thus, for example, it will be seen that the widthwise profile of the doctor blade 36 may be adjusted/warped by application of the correction force so as to straighten the widthwise profile of the doctor blade 36.

In the first exemplary embodiment, in view of a realistic mass production process, the setting value for straightness correction of the coated amount regulating surface 36*r* of the doctor blade 36 is set to approximately 20 μm to 50 μm, and the magnitude of the straightness correction force to be imparted to the front edge portions 36*e* of the doctor blade 36 is set to about 500 g. Generally, setting the magnitude of the straightness correction force to be imparted to the front edge portions 36*e* of the doctor blade 36 smaller enables the apparatus 100 to be inexpensive and to be miniaturized. However, in a case where the magnitude of the straightness correction force to be imparted to the front edge portions 36*e* of the doctor blade 36 is too small with respect to the magnitude of the rigidity of the doctor blade 36, it becomes impossible to correct the straightness of the coated amount regulating surface 36*r* of the doctor blade 36. Therefore, the magnitude of the straightness correction force to be imparted to the front edge portions 36*e* of the doctor blade 36 is set based on the magnitude of the rigidity of the doctor blade 36.

In the examples illustrated in FIG. 9, the grab portions 37 are provided at five locations of the doctor blade 36. However, it will be appreciated that the locations at which the grab portions 37 are provided on the doctor blade 36 may be different to the locations illustrated in FIG. 9. Further, the number of grab portions 37 may be fewer or greater than five. In general, the number of grab portions is determined based on the non-uniformity of the widthwise profile of the doctor blade 36 and/or how many grab portions are required to apply the necessary straight correction forces to correct the widthwise profile. Moreover, while, in the example illustrated in FIG. 9, each of the grab portions 37 of the doctor blade 36 is in a convex shape, the shape of each of the grab portions 37 is not limited to that. As mentioned above, in order for the apparatus 100 to impart, to the doctor blade 36, a force for warping at least a part of the area corresponding to the maximum image region of the doctor blade 36 (straightness correction force), the fingers 101 grasp the grab portions 37 of the doctor blade 36. Therefore, as long as the fingers 101 are able to grasp the grab portions 37, the shape of each of the grab portions 37 can be, besides a convex shape, for example, a concave shape, a groove shape, a notch shape, or a flat shape, or can be a combination of some of such shapes. Furthermore, of the drawings for the present specification, except for FIG. 9 to FIG. 12, the figures in which the doctor blade 36 is illustrated omit the grab portions 37 of the doctor blade 36 from illustration.

(2) Positioning Step

Figure 11:
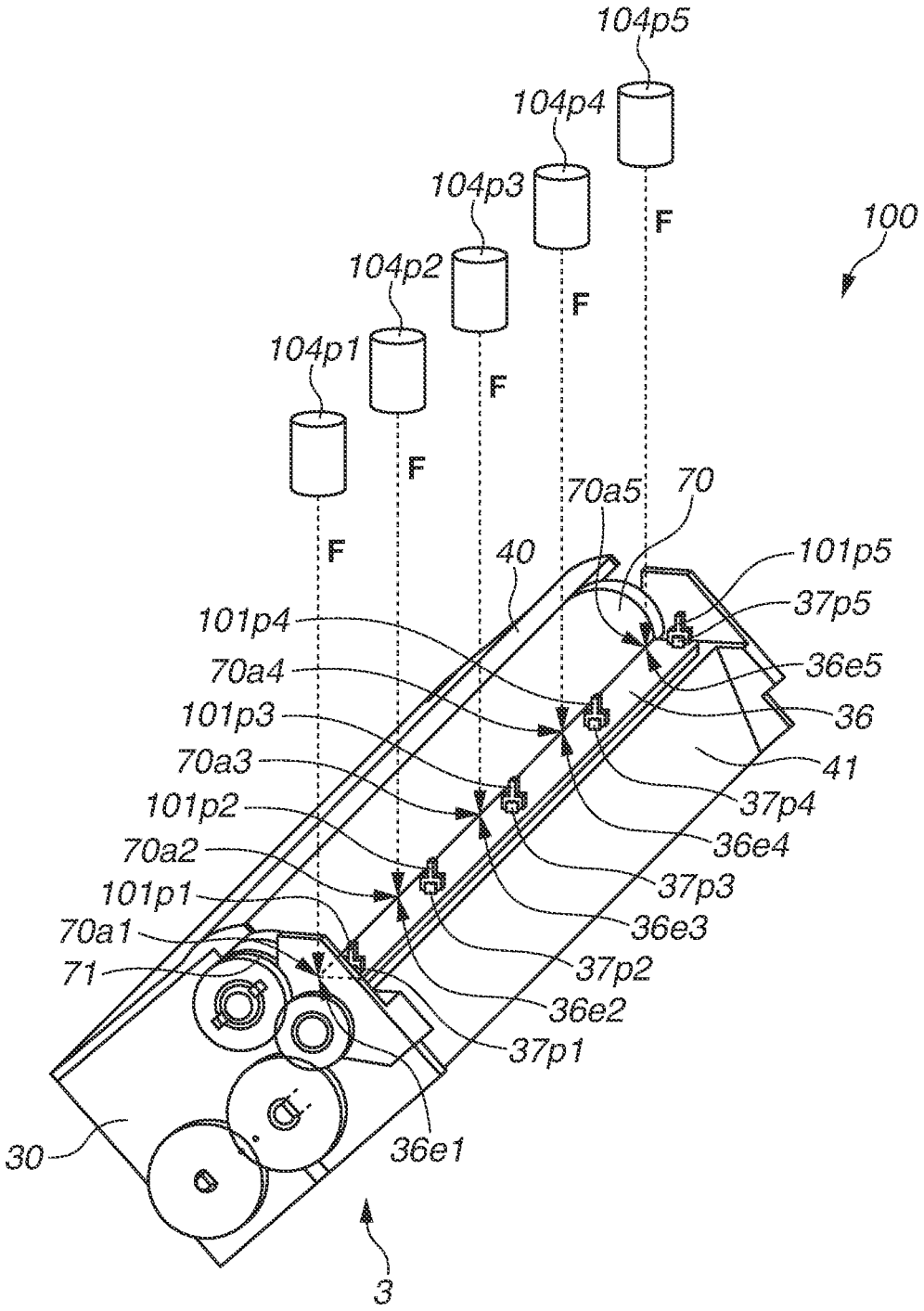
FIG. 11 is a schematic diagram used to explain steps of the method of fixing the doctor blade made of resin.
Figure 12:
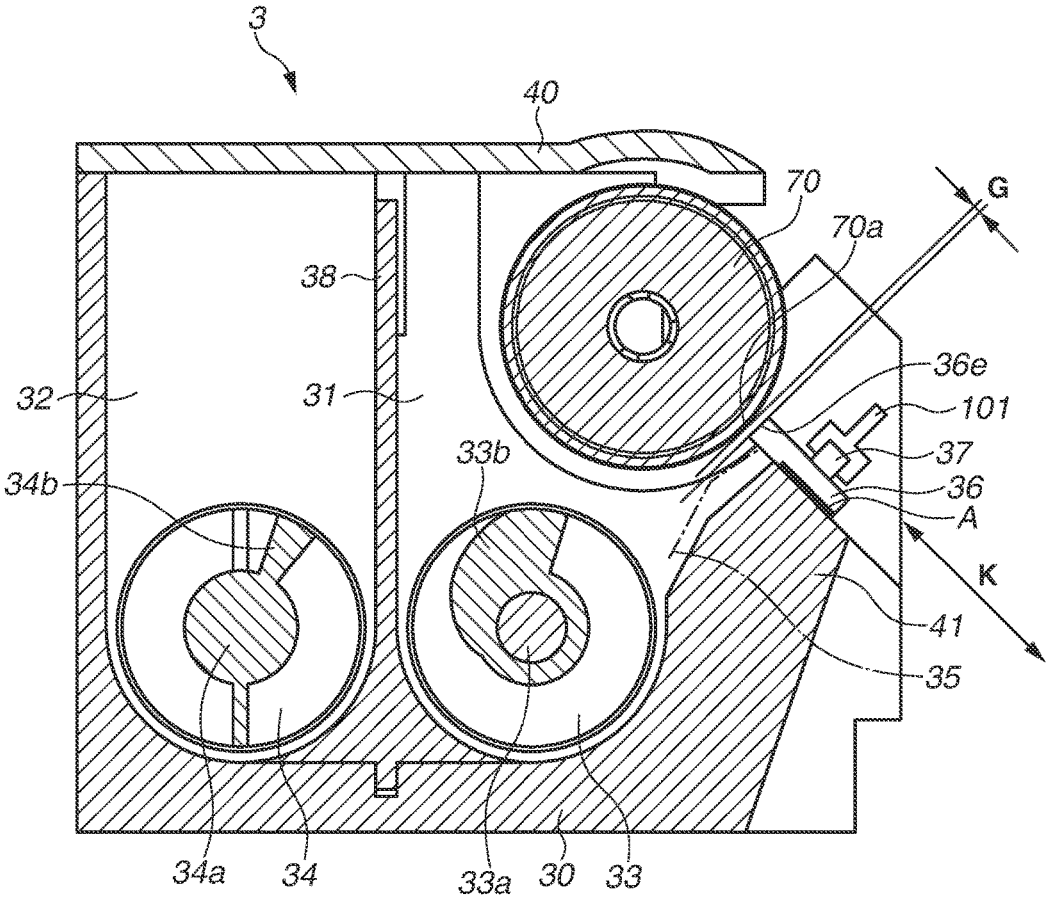
FIG. 12 is a schematic diagram used to explain steps of the method of fixing the doctor blade made of resin.

Next, details of the positioning step are described with reference to the schematic diagrams of FIG. 11 and FIG. 12. As illustrated in FIG. 11 and FIG. 12, the positioning step is performed in a state in which the developing sleeve 70 is supported by the sleeve supporting portions 42 of the development frame member 30.

The fingers 101 (101*p*1 to 101*p*5) move the doctor blade 36 from the placement board 103 to the blade attaching portion 41 while holding the doctor blade 36 kept in a warped state in the warping step (in other words, in a state in which the straightness of the coated amount regulating surface 36*r* has been corrected). Furthermore, the amount of movement and the direction of movement of the fingers 101 (101*p*1 to 101*p*5) are previously set according to a program. The fingers 101 (101*p*1 to 101*p*5) are driven by actuators and operate according to the previously-set program.

Then, in a state in which the fingers 101 (101*p*1 to 101*p*5) grasp the grab portions 37 of the doctor blade 36 kept in a warped state in the warping step, the apparatus 100 moves the doctor blade 36 kept in a warped state to the blade attaching portion 41 of the development frame member 30. Next, the apparatus 100 attaches the doctor blade 36 kept in a warped state to the blade attaching portion 41. At this time, the doctor blade 36 kept in a warped state enters a state of landing on (also referred to as a "state of abutting on") a blade attaching surface 41*s* (see FIG. 4 and FIG. 5) of the development frame member 30.

FIG. 11 illustrates a state in which the doctor blade 36 has been caused to land on the blade attaching surface 41*s* while the grab portions 37 (37P1 to 37*p*5) of the doctor blade 36 kept in a warped state are grasped by the fingers 101 (101*p*1 to 101*p*5).

As mentioned above, to prevent or reduce unevenness of the amount of a developer borne on the surface of the developing sleeve 70 in the longitudinal direction of the developing sleeve 70, the range of a tolerance of the SB gap G (in other words, a range allowed as a tolerance with respect to a target value of the SB gap G) is set to approximately 60 μm. Since the range of a tolerance of the SB gap G is severe in this way, if the doctor blade 36 is only caused to land on the blade attaching surface 41*s* of the development frame member 30, the SB gap G is unlikely to fall within an adjustment range of the SB gap G with the range of a tolerance of the SB gap G taken into consideration (in this regard, the adjustment range of the SB gap G including a target value of the SB gap G). Therefore, it is necessary to make an adjustment such that the SB gap G falls within an adjustment range of the SB gap G, by determining a position at which to fix the doctor blade 36 to the blade attaching surface 41*s* of the development frame member 30 in such a manner that the SB gap G falls within the range of a tolerance.

The apparatus 100 includes cameras 104 (104*p*1 to 104*p*5) provided at five locations to respectively measure the positions of the front edge portions 36*e* (36*e*1 and 36*e*5) provided at five locations of the doctor blade 36 caused to land on the blade attaching surface 41*s* of the development frame member 30 by the fingers 101. Each of the cameras 104 (104*p*1 to 104*p*5) is arranged along a direction toward the front edge portions 36*e* (36*e*1 and 36*e*5) of the doctor blade (the direction of arrow F in FIG. 11), and is able to measure each of the positions of the front edge portions 36*e* (36*e*1 and 36*e*5) of the doctor blade 36. Furthermore, while, in the first exemplary embodiment, an example in which the measurement of the positions of the front edge portions 36*e* (36*e*1 to 36*e*5) of the doctor blade 36 is performed by the cameras 104 (104*p*1 to 104*p*5) is hereinafter described, a modification example in which the measurement is performed by non-contact sensors can be employed.

Here, the method of measuring (a calculation method for) the magnitude of the SB gap G is described. The measurement of the magnitude of the SB gap G is performed in a state in which the developing sleeve 70 is supported by the sleeve supporting portions 42 of the development frame member 30, the doctor blade 36 is attached to the blade attaching portion 41 of the development frame member 30, and the cover frame member 40 is fixed to the development frame member 30. Moreover, during measurement of the magnitude of the SB gap G, a light source (for example, a light-emitting diode (LED) or a light guide) is inserted into the development chamber 31 over the longitudinal direction of the development chamber 31. The light source inserted into the development chamber 31 radiates light from the inside of the development chamber 31 toward the SB gap G. Then, the cameras 104 (104*p*1 to 104*p*5) capture rays of light exiting from the SB gap G to the outside of the development frame member 30. At this time, the cameras 104 (104*p*1 to 104*p*5) read positions 70*a* (70*a*1 to 70*a*5) at which the developing sleeve 70 is closest to the doctor blade 36 on the surface of the developing sleeve 70, and also read the front edge portions 36*e* (36*e*1 and 36*e*5) of the doctor blade 36. Next, the apparatus 100 converts pixel values into distances based on image data read and generated by the cameras 104 (104*p*1 to 104*p*5), and calculates the magnitude of the SB gap G based on the distances. In a case where the calculated magnitude of the SB gap G is not within a predetermined range, the apparatus 100 makes adjustment to the SB gap G.

Here, details of the method of adjusting the SB gap G are described with reference to the schematic diagram of FIG. 12. The apparatus 100 moves the fingers 101 (101*p*1 to 101*p*5) along the direction of arrow K in FIG. 12 while grasping the grab portions 37 (37P1 to 37*p*5) of the doctor blade 36 with the fingers 101. Furthermore, the direction of arrow K in FIG. 12 is a direction in which the relative position of the doctor blade 36 with respect to the developing sleeve 70 supported by the sleeve supporting portions 42 of the development frame member 30 is adjusted (in other words, a direction to define the SB gap G). Moreover, the direction of arrow K in FIG. 12 represents a direction in which the doctor blade 36 comes close to or moves away from the developing sleeve 70 supported by the sleeve supporting portions 42 of the development frame member 30. With this, the relative position of the front edge portions 36*e* (36*e*1 and 36*e*5) of the doctor blade 36 with respect to the positions 70*a* (70*a*1 to 70*a*5) at which the developing sleeve 70 is closest to the doctor blade 36 on the surface of the developing sleeve 70 is adjusted.

For example, suppose that the SB gap G calculated at an initial position in which the doctor blade 36 has been caused to land on the blade attaching surface 41*s* of the development frame member 30 is 350 μm. On the other hand, suppose that the adjustment range of the SB gap G is 300 μm±30 μm and the allowable tolerance of the SB gap G is up to 60 μm. In this case, at the initial position in which the doctor blade 36 has been caused to land on the blade attaching surface 41*s* of the development frame member 30, the calculated SB gap G is 50 μm larger than the nominal value 300 μm of the SB gap G. Therefore, the fingers 101 translate the doctor blade 36 along the direction of arrow K illustrated in FIG. 12 and in a direction to bring the doctor blade 36 close to the surface of the developing sleeve 70 by 50 μm while grasping the grab portions 37 of the doctor blade 36.

Then, the cameras 104 read the positions 70*a* (70*a*1 to 70*a*5) at which the developing sleeve 70 is closest to the doctor blade 36 translated by the fingers 101 and the front edge portions 36*e* (36*e*1 and 36*e*5) of the doctor blade 36 translated by the fingers 101. Next, the apparatus 100 re-calculates the SB gap G with respect to the doctor blade 36 translated by the fingers 101.

When determining that the magnitude of the calculated SB gap G is within the range of adjustment values of the SB gap G (300 μm±30 μm), the apparatus 100 ends adjustment of the SB gap G. On the other hand, when determining that the magnitude of the calculated SB gap G is not within the range of adjustment values of the SB gap G (300 μm±30 μm), the apparatus 100 repeats the above-described adjustment of the SB gap G until the magnitude of the calculated SB gap G falls within the adjustment range of the SB gap G (300 μm±30 μm). With the straightness of the coated amount regulating surface 36*r* corrected to 50 μm or less in this way, the doctor blade 36 is fixed to the blade attaching portion 41 of the development frame member 30, so that the magnitude of the SB gap G can be set to within the adjustment range of the SB gap G.

Here, a desirable configuration example for making adjustment of the SB gap G with a high degree of accuracy is described with reference to the schematic diagrams of FIGS. 13A and 13B and FIG. 14. In this configuration example, not only the straightness of the coated amount regulating surface 36*r* of the doctor blade 36 but also the straightness of the surface of the developing sleeve 70 is taken into consideration, so that the adjustment of the SB gap G is performed with a higher degree of accuracy.

Since a sleeve tube constituting the outer shell of the developing sleeve 70 is made of metal, performing secondary cutting work on the sleeve tube enables the straightness of the surface of the developing sleeve 70 to have a high degree of accuracy such as ±15 μm or less. However, when the developing sleeve 70 is rotating during actual use, the straightness of ±15 μm of the surface of the developing sleeve 70 is seen as if the outer diameter of the developing sleeve 70 is apparently varying by ±15 μm. To minimize an influence on the SB gap G caused by the accuracy of the straightness of the coated amount regulating surface 36*r* of the doctor blade 36 during the rotation state of the developing sleeve 70, it is effective to measure the SB gap G while rotating the developing sleeve 70.

Figure 13A:
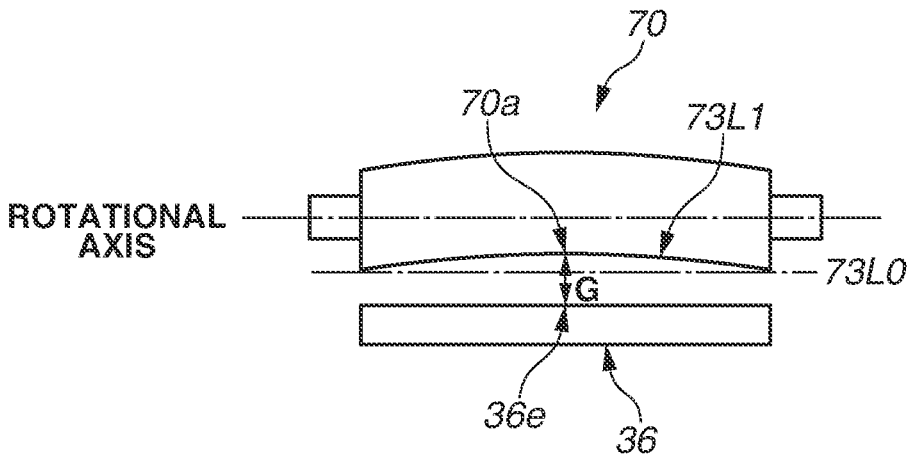
FIGS. 13A and 13B are schematic diagrams used to explain steps of the method of fixing the doctor blade made of resin.
Figure 13B:
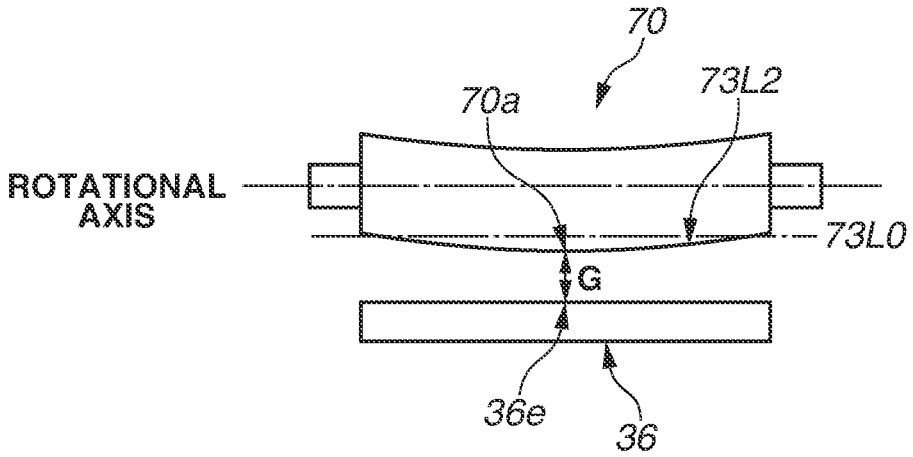
Figure 14:
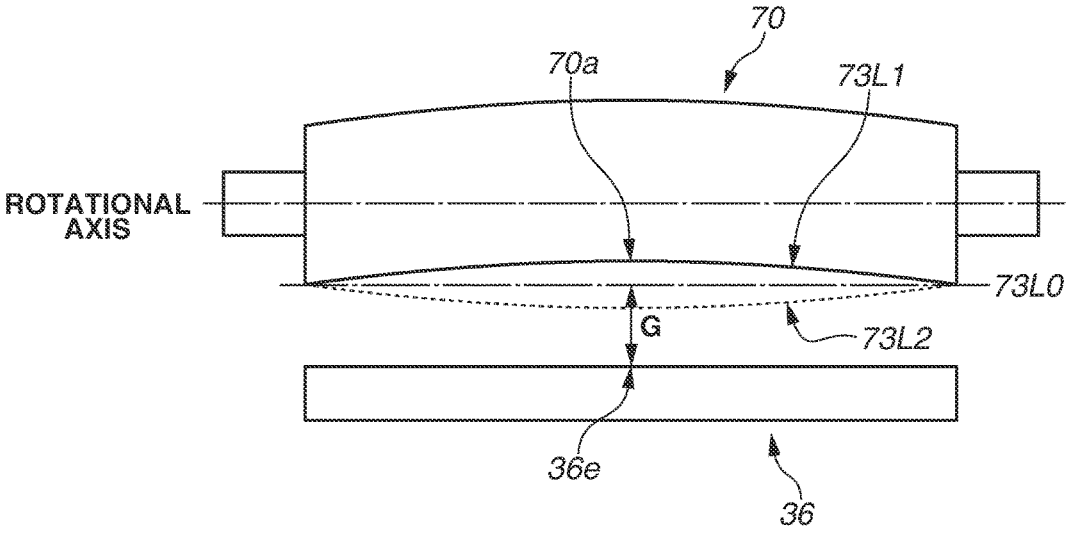
FIG. 14 is a schematic diagram used to explain steps of the method of fixing the doctor blade made of resin.

FIGS. 13A and 13B illustrate the positions of the front edge portion 36*e* of the doctor blade 36 in a state in which the developing sleeve 70 is stopped. FIG. 13A illustrates a state in which the SB gap G has been adjusted in a state in which the developing sleeve 70 is stopped at a position far from the doctor blade 36. On the other hand, FIG. 13B illustrates a state in which the SB gap G has been adjusted in a state in which the developing sleeve 70 is stopped at a position close to the doctor blade 36. Moreover, FIG. 14 illustrates the position of the front edge portion 36*e* of the doctor blade 36 in a state in which the developing sleeve 70 is rotating.

As illustrated in FIGS. 13A and 13B, while the magnitude of the SB gap G is the same between the states illustrated in FIGS. 13A and 13B, the position of the front edge portion 36*e* of the doctor blade 36 differs between the states illustrated in FIGS. 13A and 13B. Moreover, a difference occurs between the phase of the developing sleeve 70 in the state in which the developing sleeve 70 is stopped at a position far from the doctor blade 36 and the phase of the developing sleeve 70 in the state in which the developing sleeve 70 is stopped at a position close to the doctor blade 36. As a result, even if the SB gap G is adjusted with the same adjustment value of the SB gap G with use of the developing sleeve 70 of the same accuracy and the doctor blade 36 of the same accuracy, the doctor blade 36 would be fixed to the blade attaching portion 41 of the development frame member 30 in a state in which the position of the front edge portion 36*e* differs. This would result in allowing manufacturing unevenness during manufacture of the development device 3. Therefore, adjusting the SB gap G while rotating the developing sleeve 70 is employed to reduce manufacturing unevenness.

When the developing sleeve 70 is rotated, a fluctuation which is moving in and out of the outer diameter line of the developing sleeve 70 (hereinafter referred to as a "fluctuation of the outer diameter of the developing sleeve 70") occurs due to the straightness of the surface of the developing sleeve 70. As illustrated in FIG. 14, the outer diameter line of the developing sleeve 70 is seen as if the outer diameter line is moving in and out between an outer diameter line 73L1 of the developing sleeve 70 and an outer diameter line 73L2 of the developing sleeve 70 around a center line 73L0 of the fluctuation of the outer diameter of the developing sleeve 70. Therefore, measuring the fluctuation of the outer diameter of the developing sleeve 70 enables detecting the center of the fluctuation of the outer diameter of the developing sleeve 70. Thus, the method of detecting the center line 73L0 of the fluctuation of the outer diameter of the developing sleeve 70 and measuring the magnitude of the SB gap G based on the center line 73L0 of the fluctuation of the outer diameter of the developing sleeve 70 can be employed. This enables preventing or reducing unevenness of the position of the front edge portion 36*e* of the doctor blade 36, which is caused by a difference between the phase of the developing sleeve 70 in the state in which the developing sleeve 70 is stopped at a position far from the doctor blade 36 and the phase of the developing sleeve 70 in the state in which the developing sleeve 70 is stopped at a position close to the doctor blade 36.

Thus, the method of using the developing sleeve 70 of the same accuracy and the doctor blade 36 of the same accuracy and using the same adjustment value of the SB gap G while rotating the developing sleeve 70 enables reproducing the position of the front edge portion 36*e* of the doctor blade 36 at the same position. This enables reducing manufacturing unevenness.

While, as mentioned above, the straightness of the surface of the developing sleeve 70 is ±15 μm or less, to perform adjustment of the SB gap G with a higher degree of accuracy, it is necessary to take not only the straightness of the coated amount regulating surface 36*r* of the doctor blade 36 but also the straightness of the surface of the developing sleeve 70 into account. Therefore, in the positioning step, the apparatus 100 performs the following operation in a state in which the fingers 101 cause the doctor blade 36 to land on the blade attaching surface 41*s* while translating the doctor blade 36 in a direction to bring the doctor blade 36 close to the surface of the developing sleeve 70.

Before causing the doctor blade 36 to land on the blade attaching surface 41*s*, the apparatus 100 imparts a straightness correction force for correcting the straightness of the coated amount regulating surface 36*r* to the doctor blade 36 via the grab portions 37 of the doctor blade 36. More specifically, before causing the doctor blade 36 to land on the blade attaching surface 41*s*, the apparatus 100 previously corrects the straightness of the coated amount regulating surface 36*r* to 50 μm or less. Then, the apparatus 100 causes the doctor blade 36 with the straightness of the coated amount regulating surface 36*r* corrected to 50 μm or less to land on the blade attaching surface 41*s*.

Next, the apparatus 100 imparts, to the doctor blade 36 via the grab portions 37 of the doctor blade 36, an adjustment force for adjusting the relative position of the coated amount regulating surface 36*r* of the doctor blade 36 with respect to the developing sleeve 70 so as to cause the SB gap G to fall within a predetermined range (in other words, an adjustment range of the SB gap G) in a state that the doctor blade 36 is fixed to the blade attaching portion 41. More specifically, the fingers 101 warp at least a part of the area corresponding to the maximum image region of the doctor blade 36 in such a manner that the SB gap G measured by the cameras 104 falls within the adjustment range of the SB gap G in a state in which the doctor blade 36 has landed on the blade attaching surface 41*s*. At this time, at least a part of the area corresponding to the maximum image region of the doctor blade 36 enters a state of being warped in a direction in which the doctor blade 36 attached to the blade attaching portion 41 comes close to or moves away from the developing sleeve 70 supported by the sleeve supporting portions 42.

With this, the adjustment of the SB gap G with not only the straightness of the coated amount regulating surface 36*r* of the doctor blade 36 but also the straightness of the surface of the developing sleeve 70 taken into account can be performed with a higher degree of accuracy. Then, the relative position of the coated amount regulating surface 36*r* of the doctor blade 36 with respect to the developing sleeve 70 can also be performed in such a manner that the tolerance of the SB gap G becomes 60 μm or less over the longitudinal direction of the developing sleeve 70. In that case, after the relative position of the coated amount regulating surface 36*r* with respect to the developing sleeve 70 is adjusted in such a manner that the tolerance of the SB gap G becomes 60 μm or less over the longitudinal direction of the developing sleeve 70, the doctor blade 36 is fixed to the blade attaching portion 41 according to a fixation step described below.

Furthermore, in a case where the straightness of the surface of the developing sleeve 70 has a higher accuracy (for example, ±5 μm or less), the adjustment of the SB gap G only needs to be performed in consideration of the straightness of the coated amount regulating surface 36*r*, but does not necessarily need to be performed further in consideration of the straightness of the surface of the developing sleeve 70. Similarly, in a case where the latitude of the SB gap G is large, the adjustment of the SB gap G is performed in consideration of the straightness of the coated amount regulating surface 36*r* of the doctor blade 36, but does not necessarily need to be performed further in consideration of the straightness of the surface of the developing sleeve 70.

(3) Fixation Step

Next, details of the fixation step are described with reference to the schematic diagram of FIG. 12. In the first exemplary embodiment, as illustrated in FIG. 12, the fixation step is performed in a state in which the doctor blade 36 kept in a warp state in the warping step has landed at a predetermined position of the blade attaching portion of the development frame member 30 determined in the positioning step.

In the first exemplary embodiment, before causing the doctor blade 36 to land on the blade attaching surface 41*s* of the development frame member 30, the apparatus 100 applies an adhesive A to the blade attaching surface 41*s* over the approximate entirety of the area corresponding to the maximum image region. Then, the apparatus 100 bonds (fixes) the doctor blade 36 kept in a warp state in the warping step to the blade attaching portion 41 over the approximate entirety of the area corresponding to the maximum image region. At this time, the doctor blade 36 is bonded (fixed) to the blade attaching portion 41 in a state in which the straightness of the coated amount regulating surface 36*r* has been corrected to 50 μm or less.

Thus, in the first exemplary embodiment, the area warped to correct the straightness of the coated amount regulating surface 36*r*, of the area corresponding to the maximum image region of the doctor blade 36, is fixed to the blade attaching portion 41. This enables preventing or reducing the area warped to correct the straightness of the coated amount regulating surface 36*r*, of the area corresponding to the maximum image region of the doctor blade 36, from returning from the state of being warped to the original state obtained before being warped.

On the other hand, depending on the shape of the blade attaching portion 41, there may exist an area in which it is difficult for the apparatus 100 to apply the adhesive A to the blade attaching surface 41*s*. In that case, as long as the area which has received a force for warping at least a part of the area corresponding to the maximum image region of the doctor blade 36 is fixed to the blade attaching portion 41 with the adhesive A, the adhesive A is assumed not to be required to be applied to a part of the blade attaching surface 41*s*.

Therefore, the adhesive A being applied to the blade attaching surface 41*s* over the approximate entirety of the area corresponding to the maximum image region means satisfying the following condition. The condition is that the adhesive A is applied to an area which includes an area warped to correct the straightness of the coated amount regulating surface 36*r* of the area corresponding to the maximum image region of the doctor blade 36 and which is 95% or more of the area corresponding to the maximum image region in the longitudinal direction of the blade attaching surface 41*s*.

With regard to selection of the adhesive A, the adhesive A is required to have such an adhesive strength that the doctor blade 36 is prevented from coming unglued from the blade attaching surface 41*s* of the development frame member 30 in the process of an image forming operation (development operation). The load which is imparted to the doctor blade 36 in the process of an image forming operation (development operation) is about 2 kilogram-force (kgf) at the time of drop test, and, if the doctor blade 36 receiving such a magnitude of load does not come unglued from the blade attaching surface 41*s* of the development frame member 30, there is no problem. Therefore, it has been known that a sufficient adhesive strength can be ensured even with a general adhesive A, and, from a viewpoint of ensuring mass productivity, the shorter the hardening time of the adhesive A the better.

Next, the film thickness of the adhesive A which is applied to the blade attaching surface 41*s* of the development frame member 30 is described. To bond the doctor blade 36 and the blade attaching surface 41*s* of the development frame member 30 using the adhesive A, the adhesive A is arranged to intervene between the doctor blade 36 and the blade attaching surface 41*s* of the development frame member 30. In order to prevent the adhesive A intervening between the doctor blade 36 and the blade attaching surface 41*s* of the development frame member 30 from affecting the magnitude of the SB gap G, it is necessary to take the film thickness of the adhesive A which is applied to the blade attaching surface 41*s* into account.

The relationship between the film thickness of thee adhesive A and the magnitude of a breaking load of a portion bonded with the adhesive A is such a relationship that the larger the amount of the adhesive A, the larger the adhesive strength caused by the adhesive A becomes. As mentioned above, the load which is imparted to the doctor blade 36 in the process of an image forming operation (development operation) is about 2 kgf, and, in the first exemplary embodiment, in view of tolerances, the strength required as the adhesive strength of the adhesive A is set to 10 kgf or more. Therefore, to ensure 10 kgf or more as the adhesive strength of the adhesive A, the film thickness of the adhesive A which is applied to the blade attaching surface 41*s* of the development frame member 30 only needs to be set to 20 μm or more.

Next, the relationship between the thickness with which to apply the adhesive A and the magnitude of dimensional variability in the thickness direction of the adhesive A is described. Generally, the larger the film thickness of the adhesive A, the more the dimensional variability in the thickness direction of the adhesive A caused by contraction of the adhesive A at the time of hardening of the adhesive A occurs. On the other hand, the magnitude of dimensional variability in the thickness direction of the adhesive A when the film thickness of the adhesive A is 150 μm is only about 8 μm larger than the magnitude of dimensional variability in the thickness direction of the adhesive A when the film thickness of the adhesive A is 30 μm. Such a difference of about 8 μm in the magnitude of dimensional variability in the thickness direction of the adhesive A is at a negligible level as the influence of the dimensional variability in a direction perpendicular to the thickness direction of the adhesive A (in other words, in a direction to define the SB gap G). Accordingly, the upper limit of the film thickness of the adhesive A which is applied to the blade attaching surface 41*s* of the development frame member 30 is not determined based on the influence of contraction of the adhesive A but can be determined based on individual production requirements, such as the hardening time or cost of the adhesive A.

Furthermore, while, in the first exemplary embodiment, an example in which the adhesive A is applied to the blade attaching portion 41 side has been described, a modification example in which the adhesive A is applied to the doctor blade 36 side or a modification example in which the adhesive A is applied to both the blade attaching portion side and the doctor blade 36 side can be employed. Moreover, if the timing at which to apply the adhesive A to the blade attaching portion 41 side is prior to starting of the positioning step (more desirably, parallel with the warping step), the total time required for a series of steps of the fixation method for the doctor blade 36 can be shortened. In other words, this example means a series of steps of applying the adhesive A to the blade attaching portion 41 of the development frame member 30 while correcting the straightness of the coated amount regulating surface 36*r*. Therefore, in the first exemplary embodiment, the following description proceeds on the assumption that the step of applying the adhesive A to the blade attaching portion 41 side of the development frame member 30 is performed prior to starting of the positioning step.

In a case where the doctor blade 36 is fixed with the adhesive A, if, in the positioning step, the adhesive A would harden halfway through the adjustment of the SB gap G with respect to the doctor blade 36 caused to land on the blade attaching surface 41*s*, after that, the adjustment of the SB gap G becomes unable to be performed. Therefore, the adjustment of the SB gap G is required to be completed before the adhesive A hardens. The time in which the adhesive A hardens is determined based on the material of the adhesive A or the amount of application of the adhesive A. Therefore, the time in which the adhesive A hardens can be predicted to some extent. Thus, the number of times the adjustment of the SB gap G can be repeatedly performed before the adhesive A hardens is previously determined based on the time required for the adjustment of the SB gap G to be performed once. Therefore, as long as the range of the determined number of times is not exceeded, since the adhesive A has not yet hardened, the adjustment of the SB gap G can be repeatedly performed.

Furthermore, in the case of prioritizing repeatedly performing the adjustment of the SB gap G over shortening the total time required for a series of steps of the fixation method for the doctor blade 36, a modification example in which the adhesive A is applied to the blade attaching portion 41 side after the positioning step is completed can be employed. In the modification example, in the positioning step, the apparatus 100 stores, in a memory included in the apparatus 100, information about a position at which to fix the doctor blade 36 to the blade attaching surface 41*s* of the development frame member 30, which has been determined during the adjustment of the SB gap G. Then, after the positioning step is completed, the apparatus 100 performs a step of applying the adhesive A to the blade attaching portion 41 side of the development frame member 30. Then, after the adhesive A is applied to the blade attaching portion 41 side, the apparatus 100 causes the doctor blade 36 kept in a warped state in the warping step to land on the blade attaching surface 41*s* of the development frame member 30 based on the information about the fixation position for the doctor blade 36 stored in the memory. Then, after the doctor blade 36 kept in a warped state lands on the blade attaching surface 41*s*, the apparatus 100 can start the above-described fixation step.

After the adjustment of the SB gap G is completed, to bring a space between the doctor blade 36 and the blade attaching portion 41 of the development frame member 30 into a state of having an intended adhesive strength, it is necessary to keep the doctor blade 36 in close contact with the blade attaching portion 41 until the adhesive A hardens. To bond the doctor blade 36 to the blade attaching portion 41 with a sufficient adhesive strength, the degree of close contact between the doctor blade 36 and the blade attaching portion 41 is important. This is because, in a case where a gap between the doctor blade 36 and the blade attaching portion 41 is large, even if the adhesive A intervenes in the gap, the adhesive strength becomes weak.

Therefore, to bring the doctor blade 36 into close contact with the blade attaching portion 41, it is necessary to impart a given load. Specifically, while keeping the doctor blade 36 landing on the blade attaching surface 41*s* of the development frame member 30, the apparatus 100 drops a weight having a predetermined weight on the doctor blade 36, thus imparting a load for bringing the doctor blade 36 into close contact with the blade attaching portion 41. To obtain a sufficient adhesion strength, in a state in which such a load is imparted to keep the doctor blade 36 in close contact with the blade attaching portion 41, the fingers 101 have to continue holding the doctor blade 36 until the adhesive A sufficiently hardens. For example, in a case where the hardening time of the adhesive A is 15 seconds, the load for bringing the doctor blade 36 into close contact with the blade attaching portion 41 can be configured to continue being imparted for 20 seconds in view of tolerances.

Then, after the adhesion of the doctor blade 36 to the blade attaching portion 41 is completed, the apparatus 100 raises the weight, thus removing the load from the doctor blade 36. Then, the apparatus 100 causes the fingers 101 (101*p*1 to 101*p*5) to operate, and, after moving the fingers 101 (101*p*1 to 101*p*5) away from the doctor blade 36, moves the fingers 101 (101*p*1 to 101*p*5) to a preparatory position for a next operation.

The above are the details of steps of the fixation method for the doctor blade 36. In a series of steps of the fixation method described above, an example in which, before causing the doctor blade 36 the accuracy of the coated amount regulating surface 36*r* of which is about 300 μm to 500 μm to land on the blade attaching surface 41*s*, the apparatus 100 previously corrects the straightness of the coated amount regulating surface 36*r* to 50 μm or less has been described. As a result, even if the doctor blade 36 made of resin, the accuracy of the coated amount regulating surface 36*r* of which is low, is used, the SB gap G can be configured to fall within the adjustment range of the SB gap G in a state that the doctor blade 36 is fixed to the blade attaching portion 41. In this example, the function of performing the warping step and the function of performing the positioning step are performed by respective separate apparatuses 100. More specifically, the doctor blade 36 (single body) is placed on the placement board 103 of the apparatus 100 for performing the warping step, which is an apparatus different from the apparatus 100 for performing the positioning step. Then, with the doctor blade 36 (single body) placed on the placement board 103, the apparatus 100 for performing the warping step imparts, to the doctor blade 36, a force for warping at least a part of the area corresponding to the maximum image region of the doctor blade 36.

On the other hand, a modification example in which the function of performing the warping step and the function of performing the positioning step are included in the single apparatus 100 is conceivable. In that modification example, the single apparatus 100 does not previously correct the straightness of the coated amount regulating surface 36*r* to 50 μm or less before causing the doctor blade 36 the accuracy of the coated amount regulating surface 36*r* of which is about 300 μm to 500 μm to land on the blade attaching surface 41*s*. Instead, after causing the doctor blade 36 to land on the blade attaching surface 41*s*, until the adhesive A hardens, the single apparatus 100 warps at least a part of the area corresponding to the maximum image region of the doctor blade in such a manner that the SB gap G falls within the adjustment range of the SB gap G. In other words, this modification example means a series of steps of, while fixing the doctor blade 36 to the blade attaching surface 41*s*, warping at least a part of the area corresponding to the maximum image region of the doctor blade 36 in such a manner that the SB gap G falls within a predetermined range (in other words, the adjustment range of the SB gap G). As a result, even if the doctor blade 36 made of resin, the accuracy of the coated amount regulating surface 36*r* of which is low, is used, the SB gap G can be configured to fall within the adjustment range of the SB gap G in a state that the doctor blade 36 is fixed to the blade attaching portion 41.

However, as mentioned above, in a case where the doctor blade made of resin compatible with A3 size is manufactured with the accuracy of a general resin product, the straightness of the coated amount regulating surface is about 300 μm to 500 μm. From this, it is desirable that the apparatus 100 previously correct the straightness of the coated amount regulating surface 36*r* to 50 μm or less before causing the doctor blade 36 to land on the blade attaching surface 41*s*. This is because, since the adjustment of the SB gap G is performed with the straightness of the coated amount regulating surface 36*r* corrected to 50 μm or less, the required adjustment time becomes shorter as compared with the case of performing the adjustment of the SB gap G with the straightness of the coated amount regulating surface 36*r* being about 300 μm to 500 μm. In other words, since the time required for a step performed with the doctor blade 36 landing on the blade attaching surface 41*s* (the adjustment time for the SB gap G) becomes shorter, the time required for the adhesive A applied to the blade attaching surface 41*s* to harden can be set shorter. Moreover, the case where the function for performing the warping step and the function for performing the positioning step are included in the respective separate apparatuses 100 enables generally shortening the takt time as compared with the case where both functions are included in the single apparatus 100, and is, therefore, advantageous in terms of mass productivity.

Figure 15:
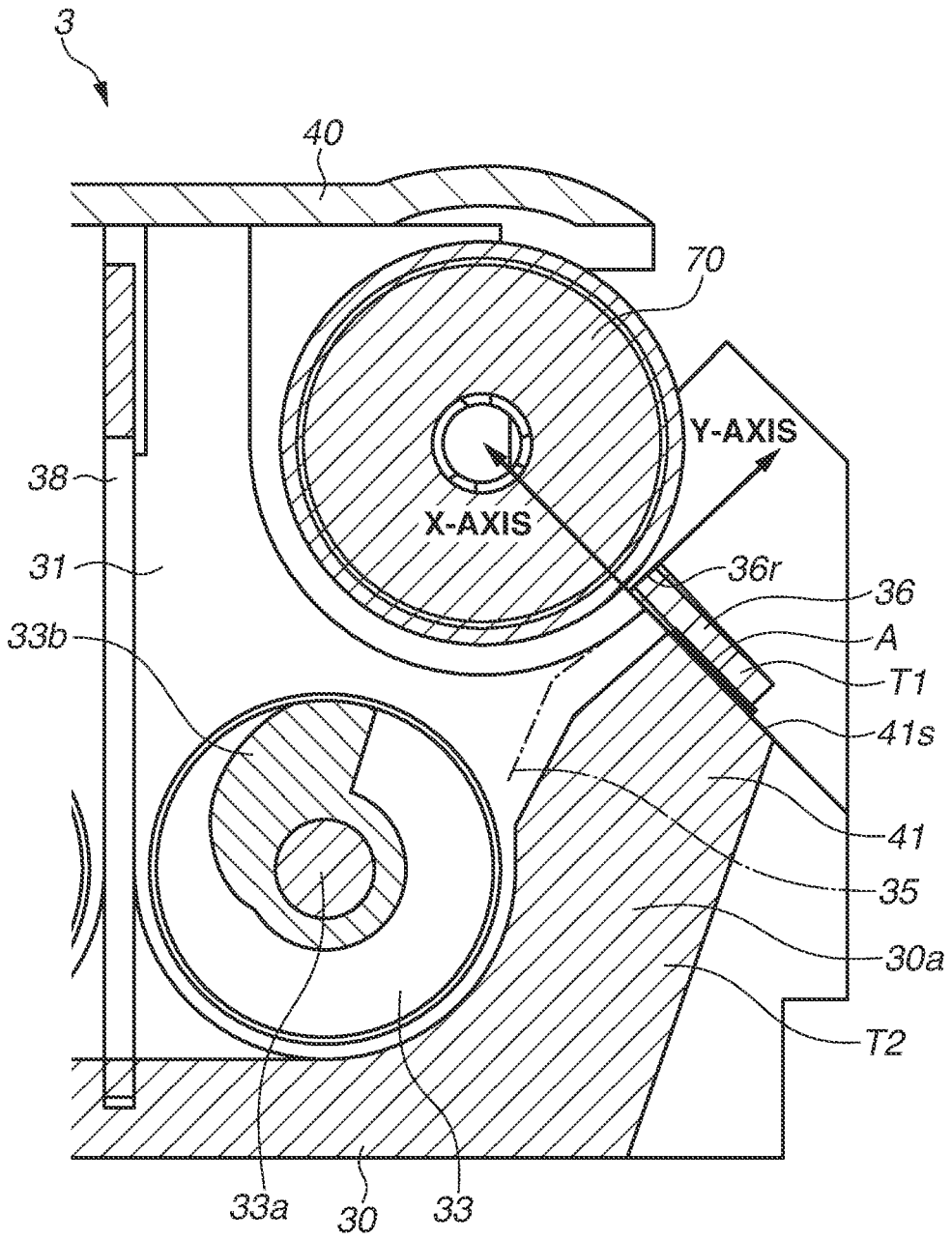
FIG. 15 is a sectional view used to explain a deformation of the doctor blade made of resin caused by a developer pressure.

Next, a deformation of the doctor blade 36 caused by the developer pressure occurring from the flow of a developer being imparted to the doctor blade 36 in the process of an image forming operation (development operation) is described with reference to the sectional view of FIG. 15. FIG. 15 is a sectional view of the development device 3 in a cross-section perpendicular to the rotational axis of the developing sleeve 70 (the cross-section H in FIG. 2). Moreover, FIG. 15 illustrates a configuration near the doctor blade 36 fixed to the blade attaching portion 41 of the development frame member 30 with the adhesive A.

As illustrated in FIG. 15, a line connecting a position of the doctor blade 36 closest to the developing sleeve 70 in the coated amount regulating surface 36*r* to the rotational center of the developing sleeve 70 is set as the X-axis. At this time, the length in the X-axis direction of the doctor blade 36 is large, and the rigidity thereof in a cross-section in the X-axis direction is also large. Moreover, as illustrated in FIG. 15, the ratio of the cross-sectional area T1 of the doctor blade 36 to the cross-sectional area T2 of the wall portion 30*a* of the development frame member 30 located near the developer guide portion 35 is small. As mentioned above, in the first exemplary embodiment, the rigidity of the development frame member 30 (single body) is set 10 times or larger than the rigidity of the doctor blade 36 (single body). Accordingly, in a state in which the doctor blade 36 is fixed to the blade attaching portion 41 of the development frame member 30, the rigidity of the development frame member 30 becomes more dominant than the rigidity of the doctor blade 36. As a result, in the process of an image forming operation (development operation), the amount of displacement (the maximum amount of warp) of the coated amount regulating surface 36*r* of the doctor blade 36 obtained when the doctor blade 36 has received the developer pressure becomes substantially equivalent to the amount of displacement (the maximum amount of warp) of the development frame member 30.

In the process of an image forming operation (development operation), a developer scooped up by the first conveyance screw 33 passes through the developer guide portion 35 and is then conveyed to the surface of the developing sleeve 70. After that, even when the layer thickness of the developer is defined by the doctor blade 36 with the magnitude of the SB gap G, the doctor blade 36 is receiving the developer pressure from various directions. As illustrated in FIG. 15, when a direction perpendicular to the X-axis direction (a direction to define the SB gap G) is set as the Y-axis, the developer pressure in the Y-axis direction is perpendicular to the blade attaching surface 41*s* of the development frame member 30. In other words, the developer pressure in the Y-axis direction becomes a force in a direction to unglue the doctor blade 36 from the blade attaching surface 41*s*. Therefore, the bonding force caused by the adhesive A is required to be sufficiently large with respect to the developer pressure in the Y-axis direction. Thus, in the first exemplary embodiment, the adhesion area or application thickness of the adhesive A with respect to the blade attaching surface 41*s* is optimized in consideration of the force acting in a direction to unglue the doctor blade 36 from the blade attaching surface 41*s* or the adhesion force of the adhesive A. Moreover, in the first exemplary embodiment, since the cross-sectional area T2 of the wall portion 30*a* of the development frame member 30 is set sufficiently large with respect to the developer pressure in the Y-axis direction which the developer guide portion 35 receives, the doctor blade 36 can be prevented or reduced from being deformed by the developer pressure in the process of an image forming operation (development operation).

Next, a deformation of the doctor blade 36 caused by the temperature being changed by heat generated in the process of an image forming operation (development operation) is described with reference to the perspective view of FIG. 16. The heat generated in the process of a development operation includes, for example, heat generated during rotation of the rotation shaft of the developing sleeve 70 with respect to the bearings 71, heat generated during rotation of the rotation shaft 33*a* of the first conveyance screw 33 with respect to the bearing members, and heat generated by the developer passing through the SB gap G. The temperature around the development device 3 changes due to these types of heat generated in the process of an image forming operation (development operation), so that the temperatures of the doctor blade 36, the development frame member 30, and the cover frame member 40 also change.

On the other hand, in a case where a linear expansion coefficient $\alpha 1$ of a resin that makes up the doctor blade 36 and a linear expansion coefficient $\alpha 2$ of a resin that makes up the development frame member 30 differ from each other, a difference of these linear expansion coefficients may vary the amount of deformation caused by a temperature change. As mentioned above, the first exemplary embodiment employs a method of fixing the doctor blade 36 to the blade attaching portion 41 of the development frame member 30 with the adhesive A over the approximate entirety of the area corresponding to the maximum image region. Moreover, in a case where there is a large difference between the linear expansion coefficient $\alpha 2$ of a resin that makes up the development frame member 30 and the linear expansion coefficient $\alpha 1$ of a resin that makes up the doctor blade 36, the following problem arises when a temperature change has occurred. Specifically, when a temperature change has occurred, the amount of deformation (amount of expansion and contraction) of the doctor blade 36 caused by the temperature change and the amount of deformation (amount of expansion and contraction) of the development frame member 30 caused by the temperature change may become different from each other.

For example, suppose that the doctor blade 36 is fixed to the blade attaching surface 41*s* at least at a first area, a second area, and a third area in the area corresponding to the maximum image region of the doctor blade 36 (for example, at least at three locations including both end portions and a central portion of the area corresponding to the maximum image region of the doctor blade 36). In this case, since the amount of thermal expansion differs between both end portions and a central portion of the doctor blade 36, the warp of the doctor blade 36 may become large, so that the doctor blade 36 may be greatly warped. As a result, even if the SB gap G is adjusted with a high degree of accuracy when the position at which to attach the doctor blade 36 to the blade attaching surface 41*s* of the development frame member 30 is determined, the magnitude of the SB gap G may be varied due to a temperature change in the process of an image forming operation (development operation).

Since, in the first exemplary embodiment, the doctor blade 36 is fixed to the blade attaching surface 41*s* over the approximate entirety of the area corresponding to the maximum image region of the doctor blade 36, it is necessary to prevent or reduce a variation of the magnitude of the SB gap G caused by a temperature change in the process of an image forming operation (development operation).

Figure 16:
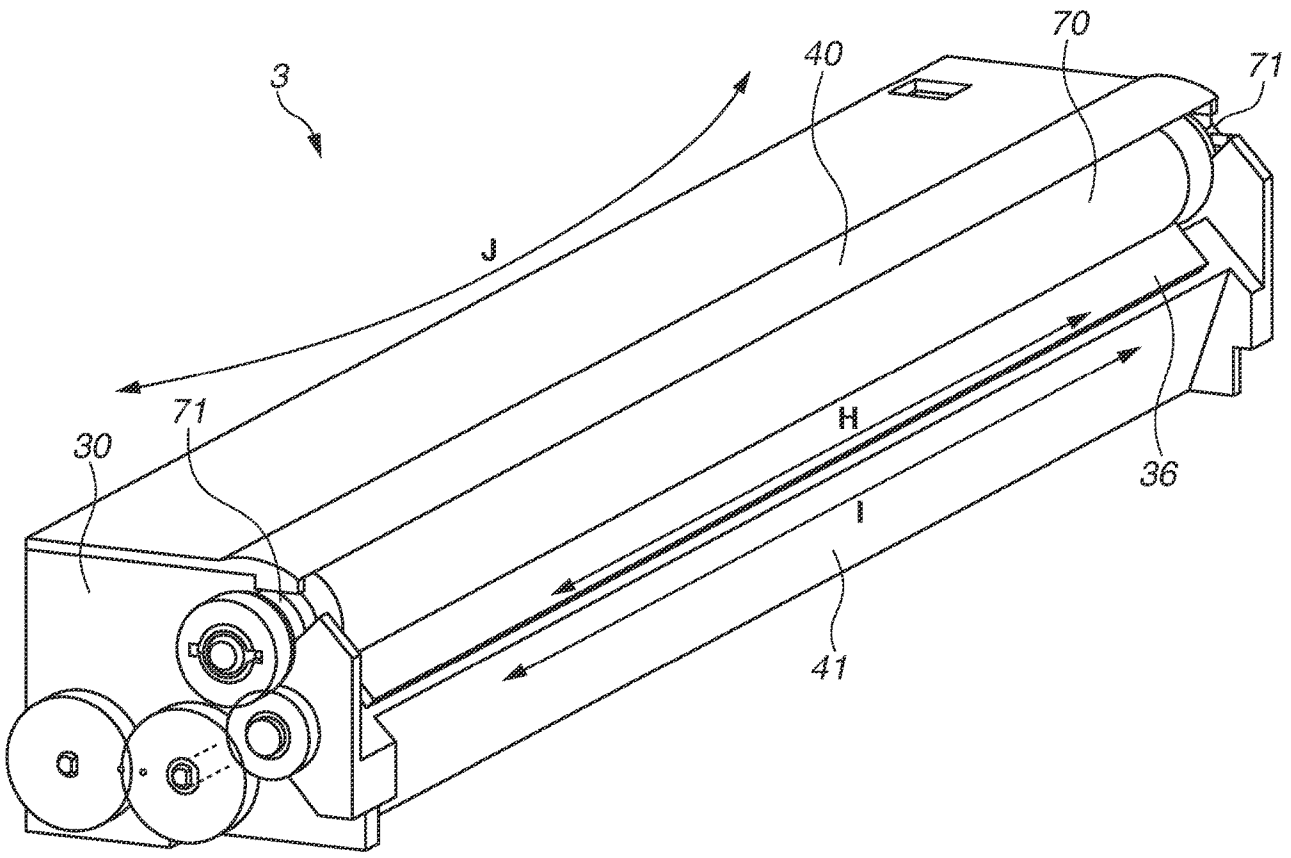
FIG. 16 is a perspective view used to explain a deformation of the doctor blade made of resin caused by a temperature change.

As illustrated in FIG. 16, suppose that the amount of extension of the doctor blade 36 caused by a temperature change is H [μm] and the amount of extension of the blade attaching surface 41*s* of the blade attaching portion 41 of the development frame member 30 caused by a temperature change is I [μm]. Moreover, suppose that the linear expansion coefficient $\alpha 1$ of a resin that makes up the doctor blade 36 and the linear expansion coefficient $\alpha 2$ of a resin that makes up the development frame member 30 differ from each other. In this case, a difference of these linear expansion coefficients causes a difference in the amount of deformation caused by a temperature change between the development frame member 30 and the doctor blade 36, so that, to make up for the difference between the amounts of extension H [μm] and I [μm], the doctor blade 36 would deform along the direction of arrow J in FIG. 16. The deformation of the doctor blade 36 along the direction of arrow J in FIG. 16 is hereinafter referred to as a "deformation in a warp direction of the doctor blade 36". Then, the deformation in a warp direction of the doctor blade 36 would lead to a variation of the magnitude of the SB gap G. Each of the linear expansion coefficient α2 of a resin that makes up the sleeve supporting portions 42 and the blade attaching portion 41 of the development frame member 30 (single body) and the linear expansion coefficient α1 of a resin that makes up the doctor blade 36 (single body) is related to preventing or reducing a variation of the magnitude of the SB gap G caused by heat.

Here, the difference of the linear expansion coefficient α2 of a resin that makes up the development frame member 30, which includes the sleeve supporting portions 42 and the blade attaching portion 41, from the linear expansion coefficient α1 of a resin that makes up the doctor blade 36 is hereinafter referred to as a "linear expansion coefficient difference α2−α1". A change of the maximum amount of warp of the doctor blade 36 caused by the linear expansion coefficient difference α2−α1 is described with use of Table 1. In a state in which the doctor blade 36 was fixed to the blade attaching portion 41 of the development frame member 30 over the approximate entirety of the area corresponding to the maximum image region, a measurement of the maximum amount of warp of the doctor blade 36 obtained when a temperature changed from an ordinary temperature (23° C.) to a high temperature (40° C.) was made.

Suppose that the linear expansion coefficient of a resin that makes up the development frame member 30, which includes the sleeve supporting portions 42 and the blade attaching portion 41, is α2 [m/° C.] and the linear expansion coefficient of a resin that makes up the doctor blade 36 is α1 [m/° C.]. Then, a result obtained by measuring the maximum amount of warp of the doctor blade 36 while varying parameters of the linear expansion coefficient difference α2−α1 is shown in Table 1.

As mentioned above, to prevent or reduce unevenness of the amount of a developer borne on the surface of the developing sleeve 70 in the longitudinal direction of the developing sleeve 70, it is generally necessary to limit the amount of variation of the SB gap G caused by heat to ±20 μm or less. Thus, in Table 1, in a case where the absolute value of the maximum amount of warp of the doctor blade 36 is 20 μm or less, the maximum amount of warp is denoted by "o", and, in a case where the absolute value of the maximum amount of warp of the doctor blade 36 is greater than 20 μm, the maximum amount of warp is denoted by "x".

TABLE 1

| Linear expansion coefficient difference α2 − α1 [$\times 10^{-5}$ m/° C.] | Maximum amount of warp of doctor blade |
|---|---|
| 0 | ○ |
| +0.20 | ○ |
| +0.40 | ○ |
| +0.50 | ○ |
| +0.54 | ○ |
| +0.55 | ○ |
| +0.56 | x |
| +0.57 | x |
| +0.60 | x |
| 0 | ○ |
| −0.20 | ○ |
| −0.40 | ○ |
| −0.44 | ○ |
| −0.45 | ○ |
| −0.46 | x |
| −0.47 | x |
| −0.50 | x |

As apparent from Table 1, to limit the amount of variation of the SB gap G caused by heat to ±20 μm or less, it is necessary to satisfy the following relational expression (1) with regard to the linear expansion coefficient difference α2−α1.

$$-0.45\times10^{-5}[\text{m/° C.}] \leq \alpha 2-\alpha 1 \leq 0.55\times10^{-5}[\text{m/° C.}] \quad (1)$$

Therefore, the resin that makes up the development frame member 30 and the resin that makes up the doctor blade 36 can be selected in such a manner that the linear expansion coefficient difference α2−α1 becomes $-0.45\times10^{-5}$ [m/° C.] or more and $0.55\times10^{-5}$ [m/° C.] or less. Selecting resins in such a manner that the linear expansion coefficient difference α2−α1 satisfies the relational expression (1) as the resin that makes up the development frame member 30 and the resin that makes up the doctor blade 36 enables limiting the amount of variation of the SB gap G caused by heat to ±20 μm or less. It is more desirable that the linear expansion coefficient difference α2−α1 be set to zero. To set the linear expansion coefficient difference α2−α1 to zero, the same resin can be selected as the resin that makes up the development frame member 30 and the resin that makes up the doctor blade 36.

Moreover, since the cover frame member 40 is fixed to the development frame member 30, if the amounts of deformation of the development frame member 30 and the cover frame member 40 caused by heat differ from each other, the deformation of the cover frame member 40 along the warp direction would lead to a variation of the magnitude of the SB gap G. As a result, even if the SB gap G is adjusted with a high degree of accuracy in the positioning step for the doctor blade 36, the magnitude of the SB gap G may be varied due to a temperature change in the process of an image forming operation (development operation).

Each of the linear expansion coefficient α2 of a resin that makes up the sleeve supporting portions 42 and the blade attaching portion 41 of the development frame member 30 (single body) and the linear expansion coefficient α3 of a resin that makes up the cover frame member 40 (single body) is related to preventing or reducing a variation of the magnitude of the SB gap G caused by a temperature change. As mentioned above, it is necessary to limit the amount of variation of the SB gap G caused by heat to ±20 μm or less. Suppose that the linear expansion coefficient of a resin that makes up the development frame member 30, which includes the sleeve supporting portions 42 and the blade attaching portion 41, is α2 [m/° C.] and the linear expansion coefficient of a resin that makes up the cover frame member 40 is α3 [m/° C.].

Here, the difference of the linear expansion coefficient α3 of a resin that makes up the cover frame member 40 from the linear expansion coefficient α2 of a resin that makes up the development frame member 30, which includes the sleeve supporting portions 42 and the blade attaching portion 41, is hereinafter referred to as a "linear expansion coefficient difference $\alpha 3-\alpha 2$". As with Table 1, it is necessary to satisfy the following relational expression (2) with regard to the linear expansion coefficient difference $\alpha 3-\alpha 2$.

$$-0.45\times10^{-5}[\text{m/° C.}]\leq\alpha 3-\alpha 2\leq 0.55\times10^{-5}[\text{m/° C.}] \quad (2)$$

Therefore, the resin that makes up the development frame member 30 and the resin that makes up the cover frame member 40 can be selected in such a manner that the linear expansion coefficient difference $\alpha 3-\alpha 2$ becomes $-0.45\times10^{-5}$ [m/° C.] or more and $0.55\times10^{-5}$ [m/° C.] or less. Selecting resins in such a manner that the linear expansion coefficient difference $\alpha 3-\alpha 2$ satisfies the relational expression (2) as the resin that makes up the development frame member 30 and the resin that makes up the cover frame member 40 enables limiting the amount of variation of the SB gap G caused by heat to ±20 μm or less. It is more desirable that the linear expansion coefficient difference $\alpha 3-\alpha 2$ be set to zero. To set the linear expansion coefficient difference $\alpha 3-\alpha 2$ to zero, the same resin can be selected as the resin that makes up the development frame member 30 and the resin that makes up the cover frame member 40.

Furthermore, when the adhesive A is applied to the doctor blade 36 or the development frame member 30, the linear expansion coefficient of the doctor blade 36 or the development frame member 30 with the adhesive A applied thereto would vary. However, the volume itself of the adhesive A applied to the doctor blade 36 or the development frame member 30 is very small, so that an influence on a change in dimension in the thickness direction of the adhesive A caused by a temperature change is at an ignorable level. Therefore, the deformation of the doctor blade 36 in a warp direction caused by the linear expansion coefficient difference $\alpha 2-\alpha 1$ varying when the adhesive A is applied to the doctor blade 36 or the development frame member 30 is at an ignorable level.

Generally, many of resin products are inferior in abrasion resistance to metal products. Factors pertaining to abrasion resistance of the doctor blade 36 include a developer pressure to be imparted to the doctor blade 36. In selecting a resin that makes up the doctor blade 36, it has been known that a resin with a larger surface hardness is more excellent in abrasion resistance.

Thus, in view of abrasion resistance, a resin having a surface hardness of 100 or more in the scale L of Rockwell hardness (JIS K7202-2) can be selected as the resin that makes up the doctor blade 36. This enables preventing or reducing abrasion of the doctor blade 36 in the process of an image forming operation (development operation). The doctor blade 36 made of such a resin has only an abrasion of 10 μm or less even in an endurance test using the equivalence of about 500,000 sheets of paper. While the larger the surface hardness of the doctor blade 36, the more the abrasion resistance of the doctor blade 36 is improved, the mass productivity of the doctor blade 36 tends to decrease. This is because a resin with a large surface hardness generally contains much toughening agent such as glass fiber. When molding is performed with a mold with use of such a resin having a large surface hardness, the toughening agent contained in the resin may damage the mold. Therefore, in a case where more than a given amount of toughening agent is contained in a resin, the mass productivity of the doctor blade 36 becomes unable to be maintained. Therefore, it has been known that selecting a resin having a surface hardness of 100 or less in the scale M of Rockwell hardness (JIS K7202-2) as the resin that makes up the doctor blade 36 enables ensuring the mass productivity of the doctor blade 36.

In the first exemplary embodiment, in view of both the abrasion resistance and mass productivity of the doctor blade 36, the doctor blade 36 is molded with use of a resin having a surface hardness of 100 or more in the scale L of Rockwell hardness and 100 or less in the scale M of Rockwell hardness. The resin having a surface hardness of 100 or more in the scale L of Rockwell hardness and 100 or less in the scale M of Rockwell hardness includes the following examples. For example, the resin includes a resin having a base material of polyphenylene ether (PPE) and polystyrene (PS) and containing a toughening agent in the range of 30% by weight or more and 35% by weight or less (hereinafter referred to as a "resin X"). Moreover, for example, the resin includes a resin having a base material of polycarbonate (PC) and acrylonitrile butadiene styrene (ABS) and containing a toughening agent in the range of 20% by weight or more and 30% by weight or less (hereinafter referred to as a "resin Y").

Thus, suppose that, in view of both the abrasion resistance and mass productivity of the doctor blade 36, the "resin X" or the "resin Y" is selected as the resin that makes up the doctor blade 36. In this case, a resin that makes up the development frame member 30 can be selected in such a manner that the difference of the linear expansion coefficient $\alpha 2$ of the development frame member 30 from the linear expansion coefficient $\alpha 1$ of the doctor blade 36 (the linear expansion coefficient difference $\alpha 2-\alpha 1$) satisfies the above-mentioned relational expression (1).

In a case where the "resin X" is selected as the resin that makes up the doctor blade 36, if the resin X" or the "resin Y" is selected as the resin that makes up the development frame member 30, the linear expansion coefficient difference $\alpha 2-\alpha 1$ satisfies the above-mentioned relational expression (1). Moreover, in a case where the "resin Y" is selected as the resin that makes up the doctor blade 36, if the resin X" or the "resin Y" is selected as the resin that makes up the development frame member 30, the linear expansion coefficient difference $\alpha 2-\alpha 1$ satisfies the above-mentioned relational expression (1).

On the other hand, in a case where the "resin X" is selected as the resin that makes up the development frame member 30, the resin X" or the "resin Y" can be selected as the resin that makes up the cover frame member 40. In this case, the difference of the linear expansion coefficient $\alpha 2$ of the development frame member 30 from the linear expansion coefficient $\alpha 3$ of the cover frame member 40 (the linear expansion coefficient difference $\alpha 2-\alpha 3$) satisfies the above-mentioned relational expression (2). Moreover, in a case where the "resin Y" is selected as the resin that makes up the development frame member 30, if the resin X" or the "resin Y" is selected as the resin that makes up the cover frame member 40, the linear expansion coefficient difference $\alpha 2-\alpha 3$ satisfies the above-mentioned relational expression (2).

As described above, in the first exemplary embodiment, a doctor blade 36 in which the accuracy of the straightness of the coated amount regulating surface **36*r* is the accuracy of a general resin product is used. Then, in a state in which the straightness of the coated amount regulating surface 36*r* has been corrected by warping a part of the area corresponding to the maximum image region of the doctor blade 36, the doctor blade 36 is configured to be fixed to the blade attaching surface 41*s* over the approximate entirety of the area corresponding to the maximum image region. With such a configuration, even if a doctor blade made of resin compatible with A3 size in which the accuracy of the straightness of the coated amount regulating surface 36***r* is low is used, the SB gap G can be configured to fall within the range of about 300 μm±30 μm (in other words, the adjustment range of the SB gap G).

Moreover, in the first exemplary embodiment, the resin that makes up the doctor blade 36 is selected in view of both the abrasion resistance and mass productivity of the doctor blade 36. Then, the resin that makes up the development frame member 30 is selected in such a manner that the difference of the linear expansion coefficient α2 of the development frame member 30 from the linear expansion coefficient α1 of the doctor blade 36 (the linear expansion coefficient difference α2−α1) satisfies the above-mentioned relational expression (1). Moreover, the resin that makes up the cover frame member 40 is selected in such a manner that the difference of the linear expansion coefficient α2 of the development frame member 30 from the linear expansion coefficient α3 of the cover frame member 40 (the linear expansion coefficient difference α2−α3) satisfies the above-mentioned relational expression (2). As a result, a variation of the magnitude of the SB gap G caused by a temperature change in the process of an image forming operation (development operation) can be prevented or reduced.

Moreover, in the first exemplary embodiment, the doctor blade 36 is configured to be fixed to the blade attaching portion 41 of the development frame member 30 over the approximate entirety of the area corresponding to the maximum image region. With this, the rigidity of the doctor blade 36 in a state of being fixed to the development frame member 30 can be made larger as compared with the case of fixing only both end portions (two locations) of the doctor blade 36 in the longitudinal direction of the doctor blade to the blade attaching portion 41. As a result, a variation of the magnitude of the SB gap G caused by the developer pressure being imparted to the doctor blade 36 in the process of an image forming operation (development operation) can be prevented or reduced.

In the above-described first exemplary embodiment, an example in which the adhesive A is applied to the blade attaching surface 41*s* of the development frame member 30 over the approximate entirety of the area corresponding to the maximum image region has been described. The adhesive A being applied to the blade attaching surface 41*s* of the development frame member 30 over the approximate entirety of the area corresponding to the maximum image region causes an area warped of the area corresponding to the maximum image region of the doctor blade 36 to be fixed to the blade attaching surface 41*s*. With this, an area warped to correct the straightness of the coated amount regulating surface 36*r* of the area corresponding to the maximum image region of the doctor blade 36 is prevented or reduced from returning from the warped state to an original state obtained before being warped.

On the other hand, a second exemplary embodiment of the invention differs from the first exemplary embodiment in that the apparatus 100 applies the adhesive A to the blade attaching surface 41*s* of the development frame member 30 not over the approximate entirety of the area corresponding to the maximum image region. In the second exemplary embodiment, the apparatus 100 stores, in the memory, information about an area warped to correct the straightness of the coated amount regulating surface 36*r* of the area corresponding to the maximum image region of the doctor blade 36. Next, the apparatus 100 determines a given area to which to apply the adhesive A of the area corresponding to the maximum image region of the blade attaching surface 41*s* of the development frame member 30 based on the information about an area warped of the doctor blade 36 stored in the memory. Then, the apparatus 100 applies the adhesive A to the determined given area of the blade attaching surface 41*s*. Furthermore, the application width or film thickness of the adhesive A to be applied to the blade attaching surface 41*s* can be determined based on the adhesion strength of the adhesive A or the amount of application of the adhesive A in view of man-hour or cost. With this, the area warped of the area corresponding to the maximum image region of the doctor blade 36 is fixed to the blade attaching surface 41*s*.

Moreover, to prevent or reduce a variation of the magnitude of the SB gap G caused by the developer pressure being imparted to the doctor blade 36 in the process of an image forming operation (development operation), it is desired to make larger the rigidity of the doctor blade 36 in a state of being fixed to the development frame member 30. Therefore, it is desirable that the apparatus 100 further apply the adhesive A to at least three locations including both end portions and an approximate central portion of the area corresponding to the maximum image region of the blade attaching surface 41*s* of the development frame member 30 in addition to the determined given area of the blade attaching surface 41*s*. Furthermore, the approximate central portion of the area corresponding to the maximum image region of the blade attaching surface 41*s* is assumed to cover an area obtained by translating the central portion of the area corresponding to the maximum image region of the blade attaching surface 41*s* toward one end side or toward the other end side by a length that is 10% or less of the length in the longitudinal direction of the area.

With this, not only the area warped of the area corresponding to the maximum image region of the doctor blade 36 but also at least three locations including both end portions and an approximate central portion of the area corresponding to the maximum image region of the doctor blade 36 are fixed to the blade attaching surface 41*s*. Therefore, since the rigidity of the doctor blade 36 in a state of being fixed to the development frame member 30 can be made larger, a variation of the magnitude of the SB gap G caused by the developer pressure being imparted to the doctor blade 36 in the process of an image forming operation (development operation) can be prevented or reduced.

Figure 17:
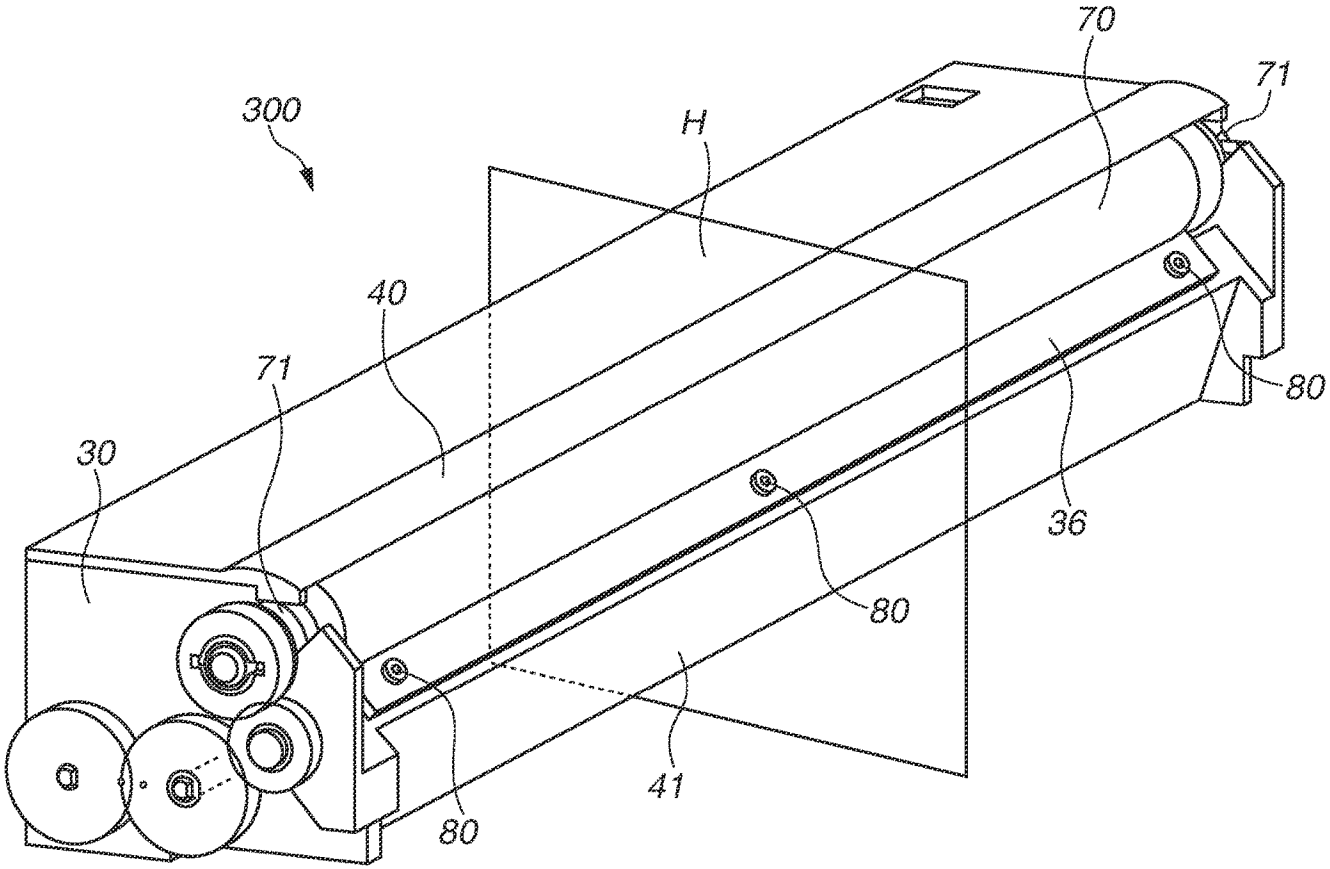
FIG. 17 is a perspective view illustrating a configuration of a development device according to a second exemplary embodiment.
Figure 18:
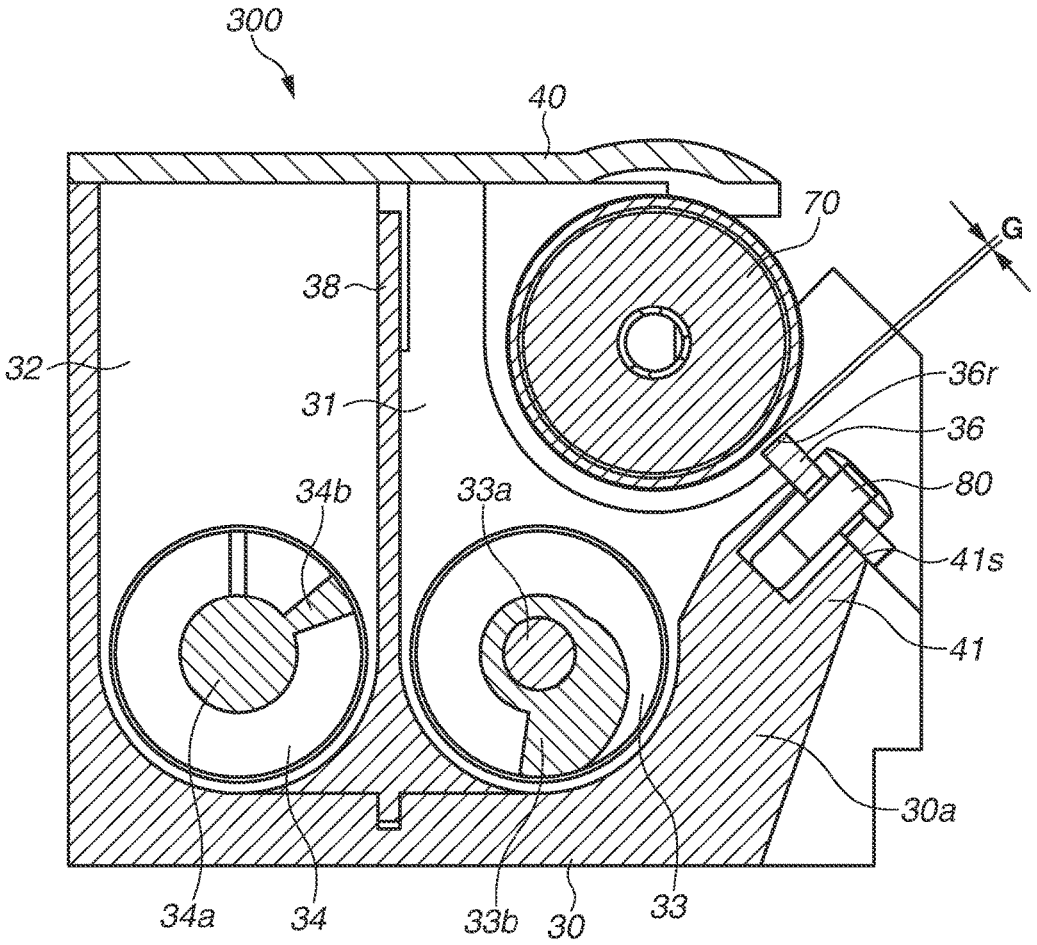
FIG. 18 is a sectional view illustrating the configuration of the development device according to the second exemplary embodiment.

Furthermore, the method of fixing at least three locations including both end portions and an approximate central portion of the area corresponding to the maximum image region of the doctor blade 36 to the blade attaching surface 41*s* is not limited to a fixation method using the adhesive A, but can be a fixation method using screws. FIG. 17 is a perspective view illustrating a configuration of a development device 300 in which three locations including both end portions and an approximate central portion of the area corresponding to the maximum image region of the doctor blade 36 are fixed to the blade attaching surface 41*s* with screws 80. FIG. 18 is a sectional view of the development device 300 in a cross-section H in FIG. 17, and illustrates a configuration near the doctor blade 36 fixed to the blade attaching portion 41 of the development frame member 30 with the screws 80. In FIG. 17, members assigned with the respective same reference characters as those in FIG. 2 have the respective same configurations. Moreover, in FIG. 18, members assigned with the respective same reference characters as those in FIG. 15 have the respective same configurations.

In the example illustrated in FIG. 17, insert nuts are inserted at fixation positions of the blade attaching surface 41*s* of the development frame member 30. Then, the screws 80 are fastened to the insert nuts, so that the fastening power for fixing the doctor blade 36 to the blade attaching surface 41*s* is increased. As long as the fastening power can be maintained, instead of the insert nuts, self-tapping screws can be used for fastening in such a manner that the screws 80 can tap their own holes as the screws 80 are driven.

To fix the doctor blade 36 to the blade attaching surface 41*s* with the screws 80, after the adjustment of the SB gap G is completed in the above-mentioned positioning step, the doctor blade 36 can be fixed to the blade attaching surface 41*s* with the screws 80. Furthermore, the grab portions 37 of the doctor blade 36 are located at positions each obtained by shifting a length equivalent to a fixed width per location by the screw 80 with respect to a screw fastening portion provided on the doctor blade 36 for fastening by the screw 80 to the blade attaching surface 41*s*. In the example illustrated in FIG. 17, the fixed width per location by the screw 80 is equivalent to the width occupied by the screw 80 for fastening, and is about 5 mm.

The invention is not limited to the above-described exemplary embodiments, but can be modified or altered in various manners (including an organic combination of some or all of the exemplary embodiments) based on the gist of the invention, which are not excluded from the scope of the invention.

While, in the above-described exemplary embodiments, as illustrated in FIG. 4, an example in which the developer guide portion 35 and the development frame member 30 are configured as an integrally formed member and the developer guide portion 35 and the doctor blade 36 are configured as separately formed members has been described, the exemplary embodiments are not limited to this example. As long as the rigidity of the doctor blade 36 (single body) allows the fingers 101 to warp the doctor blade 36 and the flow of a developer or the developer pressure in the process of a development operation is within the range of design values, the developer guide portion 35 and the doctor blade 36 can be configured as an integrally formed member.

Furthermore, while, in the above-described exemplary embodiments, as illustrated in FIG. 1, the image forming apparatus 60 having a configuration in which the intermediate transfer belt 61 is used as an image bearing member has been described as an example, the exemplary embodiments are not limited to this example. The invention can also be applied to an image forming apparatus having a configuration in which transfer is performed by sequentially bringing a recording medium into direct contact with the photosensitive drums 1. In that case, each photosensitive drum 1 constitutes a rotatable image bearing member which bears a toner image.

Figure 2:
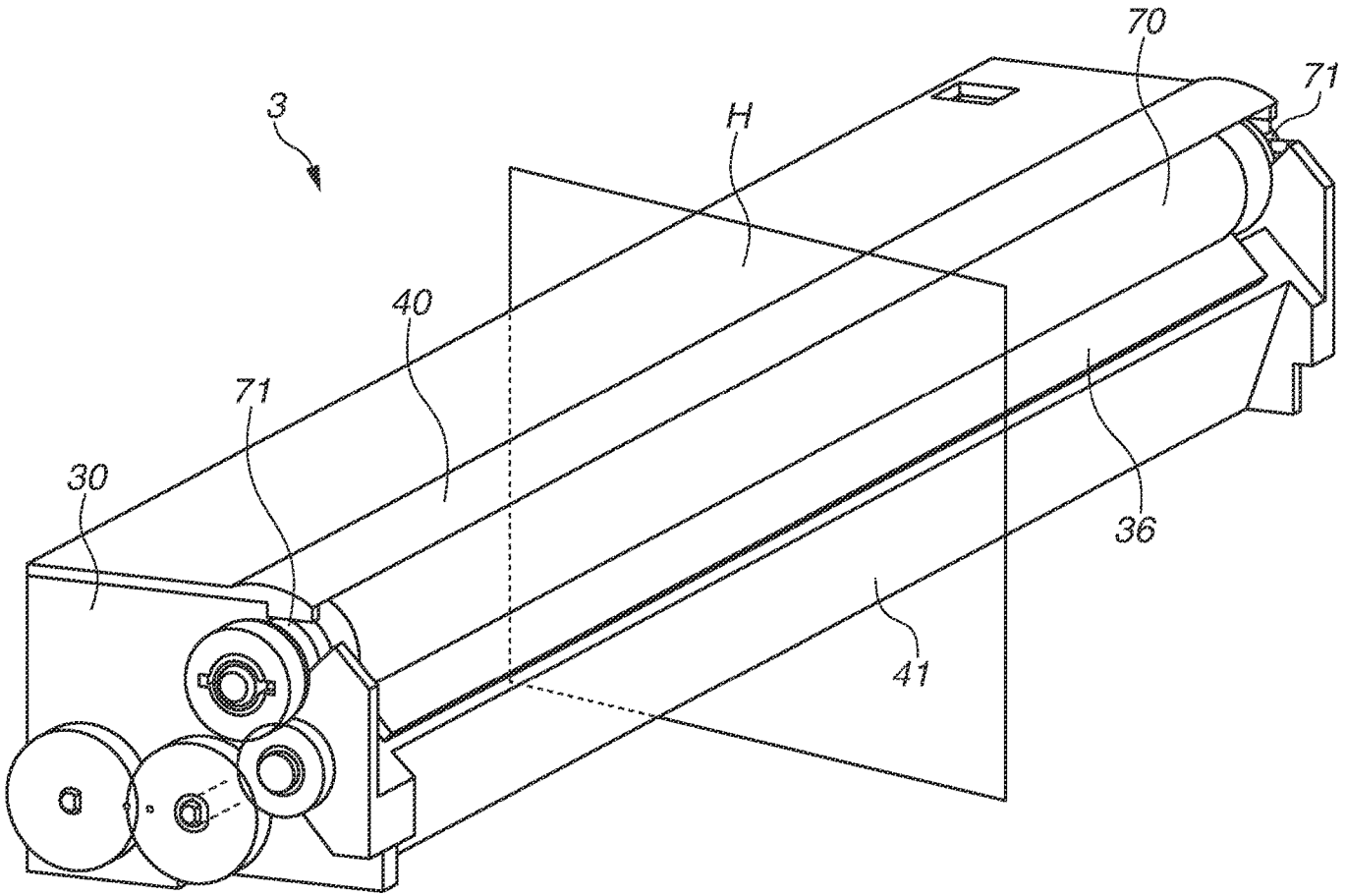
FIG. 2 is a perspective view illustrating a configuration of a development device according to a first exemplary embodiment.

Moreover, while, in the above-described exemplary embodiments, as illustrated in FIG. 2, the development device 3 having a configuration in which the developing sleeve 70 rotates counterclockwise and the doctor blade 36 is located below the developing sleeve 70 has been described as an example, the exemplary embodiments are not limited to this example. The invention can also be applied to a development device 3 having a configuration in which the developing sleeve 70 rotates clockwise and the doctor blade 36 is located above the developing sleeve 70.

Besides, while, in the above-described exemplary embodiments, as illustrated in FIG. 2, the development device 3 having a configuration in which the development chamber 31 and the agitation chamber 32 are arranged horizontally side by side with respect to the horizontal direction has been described as an example, the exemplary embodiments are not limited to this example. The invention can also be applied to a development device 3 having a configuration in which the development chamber 31 and the agitation chamber 32 are arranged vertically side by side with respect to the direction of gravitational force.

Additionally, while, in the above-described exemplary embodiments, the development device 3 has been described as a single unit, even a configuration formed as a process cartridge, which is obtained by unitizing the image forming unit 600 (see FIG. 1) including the development device 3 and is configured to be detachably attached to the image forming apparatus 60, can attain a similar advantageous effect. Moreover, the invention can be applied to any image forming apparatus 60 including such a development device 3 or process cartridge regardless of monochrome image forming apparatuses and color image forming apparatuses.

While the present invention has been described with reference to exemplary embodiments, it is to be understood that the invention is not limited to the disclosed exemplary embodiments.

This application claims the benefit of Japanese Patent Applications No. 2017-105987, filed May 29, 2017, and No. 2018-077955, filed Apr. 13, 2018, which are hereby incorporated by reference herein in their entirety.

What is claimed is:

1. A method of fixing a regulating blade made of resin to an attaching portion of a development frame member made of resin, the attaching portion being used to attach the regulating blade, the regulating blade being (i) arranged in non-contact with a developer bearing member that is arranged to carry a developer for developing an electrostatic latent image formed on an image bearing member, (ii) arranged to face the developer bearing member, and (iii) configured to regulate an amount of the developer to be carried on the developer bearing member, the method of fixing the regulating blade comprising:

a warping step comprising imparting, to the regulating blade, a force for warping the regulating blade in such a manner that a gap between the developer bearing member supported by the development frame member and the regulating blade attached to the attaching portion is adjusted to within a predetermined range along a longitudinal direction of the developer bearing member; and a fixation step comprising fixing the regulating blade to the attaching portion in a state in which the regulating blade is warped by the force imparted to the regulating blade in the warping step and the gap is within the predetermined range along the longitudinal direction of the developer bearing member.

2. The method of fixing the regulating blade according to claim 1, wherein the warping step imparts the force to the regulating blade along a direction in which a relative position of the regulating blade with respect to the developer bearing member is adjusted.

3. The method of fixing the regulating blade according to claim 1, wherein the warping step imparts the force to the regulating blade in a state that the regulating blade is attached to the attaching portion.

4. The method of fixing the regulating blade according to claim 1, further comprising an application step comprising applying an adhesive to the attaching portion, wherein the fixation step fixes the regulating blade to the attaching portion, using the adhesive which is applied to the attaching portion in the application step.

5. The method of fixing the regulating blade according to claim 1, further comprising an application step comprising applying an adhesive to the regulating blade, wherein the fixation step fixes the regulating blade to the attaching portion, using the adhesive which is applied to the regulating blade in the application step.

6. The method of fixing the regulating blade according to claim 1, wherein the regulating blade has a length corresponding to A3 size that is a length of the regulating blade at a region corresponding to a maximum image region of the image bearing member.

7. The method of fixing the regulating blade according to claim 1, wherein let $g_1$ be the gap at a first portion of a region of the regulating blade corresponding to a maximum image region of the image bearing member, let $g_2$ be the gap at a second portion of the region of the regulating blade corresponding to the maximum image region of the image bearing member, let $g_3$ be the gap at a third portion of the region of the regulating blade corresponding to the maximum image region of the image bearing member, let $g_{target}$ be a target value of the gap, when definition of $g_1$, $g_2$, $g_3$, and $g_{target}$ shown above is given, by satisfying formulae shown below, the gap is adjusted to within the predetermined range along the longitudinal direction of the developer bearing member in the warping step, $0.9\times g_1 \leq g_{target} \leq 1.1\times g_1$, $0.9\times g_2 \leq g_{target} \leq 1.1\times g_2$, and $0.9\times g_3 \leq g_{target} \leq 1.1\times g_3$.

8. The method of fixing the regulating blade according to claim 7, wherein the first portion of the region of the regulating blade corresponding to the maximum image region of the image bearing member is located at a substantially center portion of the region of the regulating blade corresponding to the maximum image region of the image bearing member, the second portion of the region of the regulating blade corresponding to the maximum image region of the image bearing member is located at one end portion of the region of the regulating blade corresponding to the maximum image region of the image bearing member, and the third portion of the region of the regulating blade corresponding to the maximum image region of the image bearing member is located at the other end portion of the region of the regulating blade corresponding to the maximum image region of the image bearing member.

9. The method of fixing the regulating blade according to claim 1, wherein a magnitude of the gap is calculated by radiating light from inside the development frame member toward the gap by a light source set inside the development frame member, and then by capturing light exiting from the gap to outside of the development frame member by a capturing unit set outside the development frame member.

10. A development device comprising:

a developer bearing member configured to carry a developer for developing an electrostatic latent image formed on an image bearing member;

a regulating blade made of resin, the regulating blade being (i) arranged in non- contact with the developer bearing member, (ii) arranged to face the developer bearing member and (iii) configured to regulate an amount of the developer to be carried on the developer bearing member; and a development frame member made of resin including an attaching portion for attaching the regulating blade, wherein the regulating blade includes a force receiving portion for receiving a force for warping the regulating blade in such a manner that a gap between the developer bearing member supported by the development frame member and the regulating blade attached to the attaching portion is adjusted to within a predetermined range along a longitudinal direction of the developer bearing member; and the regulating blade is fixed to the attaching portion in a state in which the regulating blade is warped by the force received by the force receiving portion and the gap is within the predetermined range along the longitudinal direction of the developer bearing member.

11. The development device according to claim 10, wherein the regulating blade is fixed to the attaching portion in a state in which the regulating blade is warped in a direction in which a relative position of the regulating blade with respect to the developer bearing member supported by the development frame member is adjusted.

12. The development device according to claim 10, wherein the regulating blade is attached to the attaching portion using an adhesive.

13. The development device according to claim 10, wherein the regulating blade has a length corresponding to A3 size that is a length of the regulating blade at a region corresponding to a maximum image region of the image bearing member.

14. The development device according to claim 10, wherein let $g_1$ be the gap at a first portion of a region of the regulating blade corresponding to a maximum image region of the image bearing member, let $g_2$ be the gap at a second portion of the region of the regulating blade corresponding to the maximum image region of the image bearing member, let $g_3$ be the gap at a third portion of the region of the regulating blade corresponding to the maximum image region of the image bearing member, let $g_{target}$ be a target value of the gap, when definition of $g_1$, $g_2$, $g_3$, and $g_{target}$ shown above is given, by satisfying formulae shown below, the gap is adjusted to within the predetermined range along the longitudinal direction of the developer bearing member in the warping step, $0.9\times g_1 \leq g_{target} \leq 1.1\times g_1$, c$0.9\times g_2 \leq g_{target} \leq 1.1\times g_2$, and $0.9\times g_3 \leq g_{target} \leq 1.1\times g_3$.

15. The development device according to claim 14, wherein the first portion of the region of the regulating blade corresponding to the maximum image region of the image bearing member is located at a substantially center portion of the region of the regulating blade corresponding to the maximum image region of the image bearing member, the second portion of the region of the regulating blade corresponding to the maximum image region of the image bearing member is located at one end portion of the region of the regulating blade corresponding to the maximum image region of the image bearing member, and the third portion of the region of the regulating blade corresponding to the maximum image region of the image bearing member is located at the other end portion of the region of the regulating blade corresponding to the maximum image region of the image bearing member.

16. A method of attaching a regulating blade made of resin to an attaching portion of a development frame member made of resin, the attaching portion being used to attach the regulating blade, the regulating blade being (i) arranged in non-contact with a developer bearing member that is arranged to carry a developer for developing an electrostatic latent image formed on an image bearing member, (ii) arranged to face the developer bearing member, and (iii) configured to regulate an amount of the developer to be carried on the developer bearing member, the method of attaching the regulating blade comprising:

a warping step comprising imparting, to the regulating blade, a force for warping the regulating blade in such a manner that a gap between the developer bearing member supported by the development frame member and the regulating blade attached to the attaching portion is adjusted to within a predetermined range along a longitudinal direction of the developer bearing member; and an attaching step comprising attaching, using an adhesive, the regulating blade to the attaching portion in a state where the regulating blade is kept warped by the force imparted to the regulating blade in the warping step.

17. The method of attaching the regulating blade according to claim 16, wherein the warping step imparts the force to the regulating blade along a direction in which a relative position of the regulating blade with respect to the developer bearing member is adjusted.

18. The method of attaching the regulating blade according to claim 16, wherein the warping step imparts the force to the regulating blade in a state that the regulating blade is attached to the attaching portion.

19. The method of attaching the regulating blade according to claim 16, further comprising an application step comprising applying the adhesive to the attaching portion, wherein the attaching step attaches the regulating blade to the attaching portion, using the adhesive which is applied to the attaching portion in the application step.

20. The method of attaching the regulating blade according to claim 16, further comprising application step comprising applying the adhesive to the regulating blade wherein the attaching step attaches the regulating blade to the attaching portion, using the adhesive which is applied to the regulating blade in the application step.

21. The method of attaching the regulating blade according to claim 16, further comprising a fixation step comprising fixing the regulating blade, which is attached to the attaching portion in the attaching step, to the attaching portion in a state in which the gap is within the predetermined range along the longitudinal direction of the developer bearing member.

22. The method of attaching the regulating blade according to claim 16, wherein the regulating blade has a length corresponding to A3 size that is a length of the regulating blade at a region corresponding to a maximum image region of the image bearing member.

23. The method of attaching the regulating blade according to claim 16, wherein let $g_1$ be the gap at a first portion of a region of the regulating blade corresponding to a maximum image region of the image bearing member, let $g_2$ be the gap at a second portion of the region of the regulating blade corresponding to the maximum image region of the image bearing member, let $g_3$ be the gap at a third portion of the region of the regulating blade corresponding to the maximum image region of the image bearing member, let $g_{target}$ be a target value of the gap, when definition of $g_1$, $g_2$, $g_3$, and $g_{target}$ shown above is given, by satisfying formulae shown below, the gap is adjusted to within the predetermined range along the longitudinal direction of the developer bearing member in the warping step, $0.9\times g_1 \leq g_{target} \leq 1.1\times g_1$, $0.9\times g_2 \leq g_{target} \leq 1.1\times g_2$, and $0.9\times g_3 \leq g_{target} \leq 1.1\times g_3$.

24. The method of attaching the regulating blade according to claim 23, wherein the first portion of the region of the regulating blade corresponding to the maximum image region of the image bearing member is located at a substantially center portion of the region of the regulating blade corresponding to the maximum image region of the image bearing member, the second portion of the region of the regulating blade corresponding to the maximum image region of the image bearing member is located at one end portion of the region of the regulating blade corresponding to the maximum image region of the image bearing member, and the third portion of the region of the regulating blade corresponding to the maximum image region of the image bearing member is located at the other end portion of the region of the regulating blade corresponding to the maximum image region of the image bearing member.

25. The method of attaching the regulating blade according to claim 16, wherein a magnitude of the gap is calculated by radiating light from inside the development frame member toward the gap by a light source set inside the development frame member, and then by capturing light exiting from the gap to outside of the development frame member by a capturing unit set outside the development frame member.

* * * * *